US009091239B2

(12) United States Patent
Sumi et al.

(10) Patent No.: US 9,091,239 B2
(45) Date of Patent: Jul. 28, 2015

(54) ENGINE HAVING DISPLACEABLE ELASTIC FILM

(71) Applicant: MAKITA CORPORATION, Aichi (JP)

(72) Inventors: Takuya Sumi, Numazu (JP); Ryosuke Ito, Sunto-gun (JP)

(73) Assignee: MAKITA CORPORATION, Aichi (JP)

( * ) Notice: Subject to any disclaimer, the term of this patent is extended or adjusted under 35 U.S.C. 154(b) by 140 days.

(21) Appl. No.: 13/896,688

(22) Filed: May 17, 2013

(65) Prior Publication Data

US 2014/0026863 A1 Jan. 30, 2014

(30) Foreign Application Priority Data

Jul. 25, 2012 (JP) ..... 2012-164597
Jul. 25, 2012 (JP) ..... 2012-164598

(51) Int. Cl.

| | |
|---|---|
| ***F02M 59/14*** | (2006.01) |
| ***F02M 37/04*** | (2006.01) |
| ***F02M 17/04*** | (2006.01) |
| *F02M 37/14* | (2006.01) |
| *F02M 37/18* | (2006.01) |
| *F02M 1/16* | (2006.01) |
| *F02M 5/12* | (2006.01) |
| *F02M 35/024* | (2006.01) |

(52) U.S. Cl.

CPC ..... *F02M 59/14* (2013.01); *F02M 17/04* (2013.01); *F02M 37/046* (2013.01); *F02M 1/16* (2013.01); *F02M 5/125* (2013.01); *F02M 35/024* (2013.01); *F02M 37/14* (2013.01); *F02M 37/18* (2013.01)

(58) Field of Classification Search

CPC ..... F02M 17/04; F02M 1/16; F02M 35/024; F02M 37/046; F02M 37/14; F02M 37/18; F02M 59/14; F02M 5/125; F02M 37/12
USPC ..... 123/395, 495, 73 C, 509, 73 R–73 SP; 261/35, DIG. 68; 417/395
See application file for complete search history.

(56) References Cited

U.S. PATENT DOCUMENTS 1,380,771 A * 6/1921 Cartwright ..... 123/510
3,441,010 A * 4/1969 Barr et al. ..... 123/445

(Continued)

FOREIGN PATENT DOCUMENTS

DE 4223756 1/1994
DE 102008058498 5/2010

(Continued)

OTHER PUBLICATIONS

Search report from E.P.O., mail date is Oct. 17, 2013.

*Primary Examiner* — Erick Solis
*Assistant Examiner* — Carl Staubach
(74) *Attorney, Agent, or Firm* — Greenblum & Bernstein, P.L.C.

(57) ABSTRACT

An engine includes: a piston; a carburetor having a diaphragm fuel pump, the diaphragm fuel pump including a pump chamber configured to suck and discharge fuel and a diaphragm chamber to which a pressure to drive the pump chamber is applied; and a communicating passage configured to connect between the diaphragm chamber and a negative pressure part in which a negative pressure is created due to movement of the piston. A flowback prevention part is formed in the communicating passage to allow fluid to move only in on direction from the diaphragm chamber to the negative pressure part.

10 Claims, 21 Drawing Sheets

(56) References Cited

U.S. PATENT DOCUMENTS

| | | | | | |
|---|---|---|---|---|---|
| 5,419,686 | A | | 5/1995 | Wissmann et al. | |
| 5,682,845 | A | * | 11/1997 | Woody | 123/73 A |
| 6,017,199 | A | * | 1/2000 | Yanaka | 417/395 |
| 6,194,812 | B1 | * | 2/2001 | Klugl et al. | 310/328 |
| 6,395,049 | B2 | | 5/2002 | Knodler et al. | |
| 7,775,194 | B2 | * | 8/2010 | Kono et al. | 123/517 |
| 2001/0005984 | A1 | | 7/2001 | Knodler et al. | |
| 2009/0308357 | A1 | | 12/2009 | Kono et al. | |
| 2010/0126475 | A1 | | 5/2010 | Joos et al. | |
| 2012/0204840 | A1 | * | 8/2012 | Sugiyama et al. | 123/495 |
| 2014/0026857 | A1 | * | 1/2014 | Tsutsui et al. | 123/447 |

FOREIGN PATENT DOCUMENTS

| | | | |
|---|---|---|---|
| EP | 2048352 | | 4/2009 |
| EP | 2487357 | | 8/2012 |
| JP | SHO49-73528 | * | 11/1972 |
| JP | 03-189363 | | 8/1991 |
| JP | 09-158806 | | 6/1997 |
| JP | 2001-207914 | | 8/2001 |
| JP | 2003-172221 | | 6/2003 |
| JP | 2005-140027 | | 6/2005 |
| JP | 2010090846 A | * | 4/2010 |

* cited by examiner

ENGINE HAVING DISPLACEABLE ELASTIC FILM

BACKGROUND

1. Technical Field

The present invention relates to an engine that drives a diaphragm fuel pump using negative pressure.

2. Related Art

Patent literatures 1 and 2 disclose a technology for driving a fuel pump (diaphragm fuel pump) of a two-stroke engine by using pressure fluctuation in an intake port as power source. Meanwhile, Patent literatures 3, 4 and 5 disclose a technology for driving a diaphragm chamber of a diaphragm fuel pump by using positive pressure and negative pressure in a crank chamber as power source.

Patent literature 1: Japanese Patent Application Laid-Open No. 2005-140027

Patent literature 2: Japanese Patent Application Laid-Open No. HEI9-158806

Patent literature 3: Japanese Patent Application Laid-Open No. HEI3-189363

Patent literature 4: Japanese Patent Application Laid-Open No. 2003-172221

Patent literature 5: Japanese Patent Application Laid-Open No. 2001-207914

SUMMARY

In view of the above-described problems, it is therefore an object of the present invention to provide an engine configured to prevent oil from flowing into a communicating passage for applying negative pressure, while providing the negative pressure from a negative pressure part to a diaphragm chamber of the diaphragm fuel pump. Another object of the present invention is to provide an engine configured to provide driving force generated by the pressure fluctuation in the pressure fluctuation part, to the diaphragm chamber of the diaphragm fuel pump, while preventing oil from flowing into a communicating passage that provides the pressure fluctuation to the diaphragm chamber.

To solve the above-described problems, an engine according to a first aspect of the present invention includes: a piston; a carburetor having a diaphragm fuel pump, the diaphragm fuel pump including a pump chamber configured to suck and discharge fuel and a diaphragm chamber to which a pressure to drive the pump chamber is applied; and a communicating passage configured to connect between the diaphragm chamber and a negative pressure part in which a negative pressure is created due to movement of the piston. A flowback prevention part is formed in the communicating passage to allow fluid to move only in on direction from the diaphragm chamber to the negative pressure part.

To solve the above-described problems, an engine according to a second aspect of the present invention includes: a piston; a carburetor; an elastic film; a first chamber formed in one side of the elastic film; a second chamber formed in the other side of the elastic film; and a diaphragm fuel pump provided in the carburetor, the diaphragm fuel pump including a pump chamber configured to suck and discharge fuel, and a diaphragm chamber to which a pressure to drive the pump chamber is applied. The first chamber communicates with a pressure fluctuation part in which there is pressure fluctuation due to movement of the piston, and the second chamber communicates with the diaphragm chamber.

With the present invention, it is possible to provide an engine configured to reliably prevent oil from flowing into the communicating passage to provide a negative pressure, while providing the negative pressure from the negative pressure part to the diaphragm chamber of the diaphragm fuel pump.

In addition, with the present invention, it is possible to provide an engine configured to prevent oil from flowing into the communicating passage that provides pressure fluctuation to the diaphragm chamber, while providing driving force due to the pressure fluctuation in the pressure fluctuation part, to the diaphragm chamber of the diaphragm fuel pump.

DESCRIPTION OF EXEMPLARY EMBODIMENTS

Embodiment 1

Figure 1:
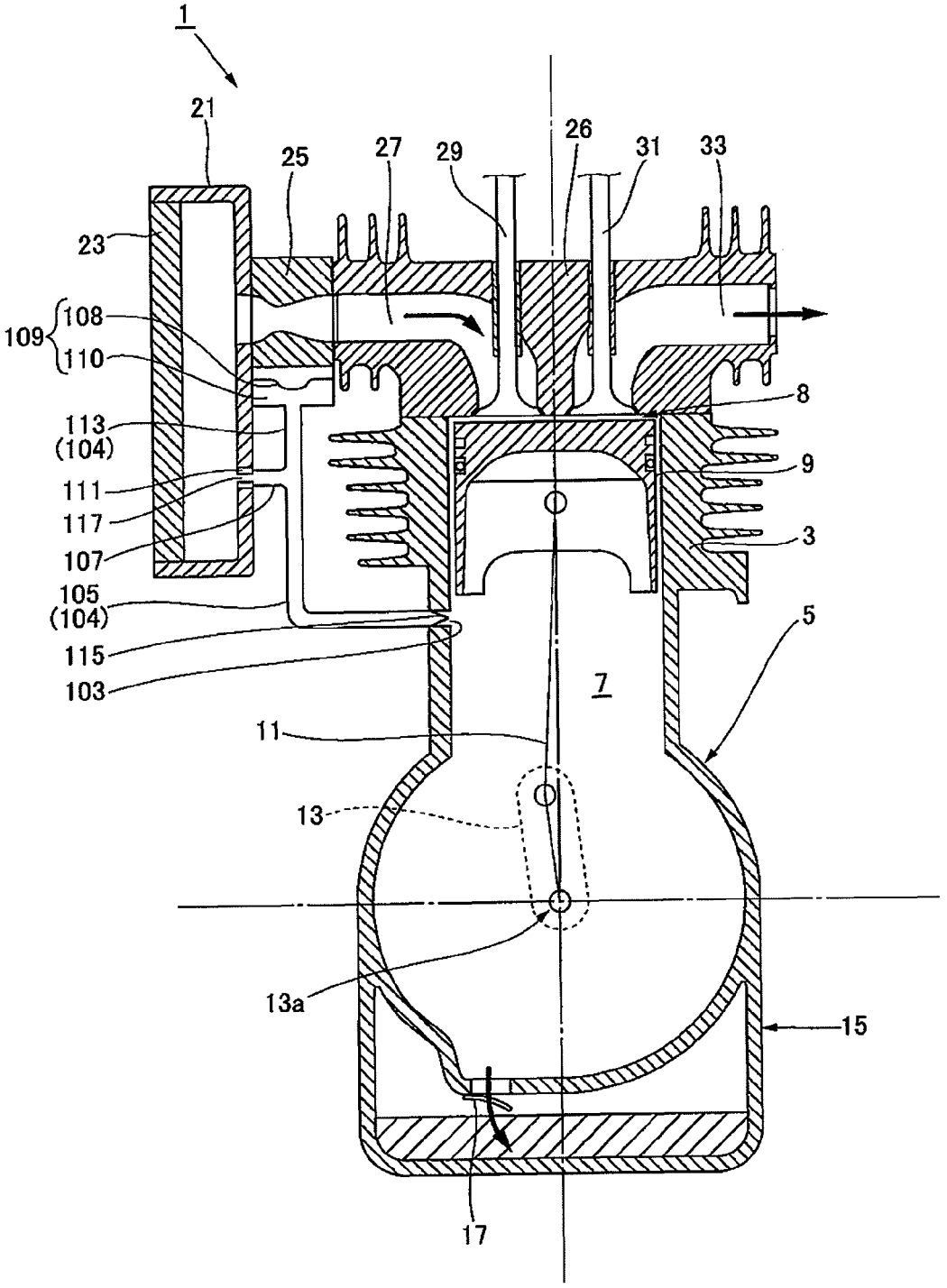
FIG. 1 is a schematic view showing a four-stroke engine according to Embodiment 1 of the present invention.

Now, the engine according to Embodiment 1 of the present invention will be explained with reference to FIG. 1. FIG. 1 is a schematic view showing the four-stroke engine according to Embodiment 1 of the present invention. Here, FIG. 1 shows a four-stroke engine 1 in a state in which a piston is located in the vicinity of the top dead center (TDC).

As shown in FIG. 1, the four-stroke engine 1 includes a cylinder part 3, a crankcase 5 mounted under the cylinder part 3 and an oil tank 15 provided below the crankcase 5. The cylinder part 3 has a cylindrical space to slidably move a piston 9 upward and downward in FIG. 1. Then, the piston 9 is fitted into the space with a gap to slidably move upward and downward in FIG. 1. A crank chamber 7 is defined by the cylinder part 3, the crankcase and the piston 9. That is, the crank chamber 7 is an approximately cylindrical space defined by the side surface of the cylinder part 3, the piston 9 and the crankcase 5. The volume of the inner space of this crank chamber 7 varies as the piston 9 slidably moves. A combustion chamber 8 is defined by the cylinder head 26, the cylinder part 3 and the piston 9. The oil tank 15 to store oil is provided separately from the crankcase 5.

A crank chamber check valve 17 is provided between the oil tank 15 and the crankcase 5 to allow oil to flow only in one direction from the crankcase 5 (crank chamber 7) to the oil tank 15. Here, a negative pressure is created in the crank chamber 7 as the piston 9 moves from the bottom dead center (BDC) to TDC. By contrast with this, a positive pressure is created in the crank chamber 7 as the piston 9 moves from TDC to BDC. Although a negative pressure is easily created in the crank chamber 7 because the crank chamber check valve 17 is provided, the pressure in the crank chamber 7 can rise only up to a positive pressure that overcomes the elasticity of a spring and so forth used in the crank chamber check valve 17. Then, the elasticity of a spring and so forth used in the crank chamber check valve 17 is relatively poor, so that the pressure in the crank chamber 7 can only increase to a positive pressure a little. The crank chamber 7 is a negative pressure part because a negative pressure is created in the crank chamber 7 when the piston 9 moves from BDC to TDC. Here, the pressure in the crank chamber 7 changes once while a crank axle 13*a* rotates once. This is different from the pressure in an intake port or an exhaust port, which changes only once while the crank axle 13*a* rotates twice.

A crank 13 is rotatably supported in the crankcase 5. This crank 13 is formed by the crank axle 13*a* which is the center of rotation, counterweight and so forth. The piston 9 and the crank 13 are connected one another via a connecting rod 11. The connecting rod 11 is rotatably connected to both the piston 9 and the crank 13. This configuration allows the piston 9 to reciprocally and slidably move in the cylinder part 3.

A cylinder head 26 is provided on the upper wall of the cylinder part 3. The cylinder head 26 is provided with an intake port 27 that allows communication with the carburetor 25 and an exhaust port 33 that allows communication with an exhaust muffler (not shown). The cylinder head 26 is also provided with an intake valve 29 to open and close the intake port 27. In addition, the cylinder head 26 is provided with an exhaust valve 31 to open and close the exhaust port 33. A negative pressure is created in the intake port 27 every time the intake valve 29 opens and closes. Therefore, also the intake port 27 is a negative pressure part.

An air cleaner 21 is provided outside the carburetor 25. A filter 23 is disposed in the air cleaner 21. The filter 23 allows air to pass through to remove dust and so forth in the air.

The carburetor 25 is an apparatus to mix fuel into the air having passed through the air cleaner 21. To be more specific, the carburetor 25 can control mixing of the air and fuel and also control the total amount of the air-fuel mixture. The carburetor 25 has a diaphragm fuel pump 109 to mix fuel into the air. This diaphragm fuel pump 109 is driven by using pressure fluctuation as power.

With the present embodiment, a diaphragm chamber 110 in the diaphragm fuel pump 109 is connected to the crank chamber 7 via a communicating passage 104 to supply the power to drive the diaphragm fuel pump 109. Here, the diaphragm fuel pump 109 is provided with a diaphragm 108 whose position changes in response to pressure fluctuation. Although with Embodiment 1, the communicating passage 104 is open in the cylinder part 3, it is by no means limiting but the communicating passage 104 may be open in a negative pressure part. When the communicating passage 104 is open in the cylinder part 3, it is advantageous to supply a pulsed negative pressure to the diaphragm fuel pump 109. This will be described later.

A crank chamber side opening 103 is provided in the communicating passage 104 in the crank chamber 7 side. Then, an atmospheric pressure opening passage 107 is connected to the communicating passage 104. One end of the atmospheric pressure opening passage 107 has an air cleaner side opening 117 which opens in the air cleaner 21 (the space after the air has passed through the filter 23). The other end of the atmospheric pressure opening passage 107 opens on the way of the route of the communicating passage 104. Here, with respect to the connecting point between the communicating passage 104 and the atmospheric pressure opening passage 107, the communicating passage 104 in the diaphragm chamber 110 side is referred to as a diaphragm chamber side communicating passage 113, and the communicating passage 104 in the crank chamber 7 side is referred to as a crank chamber side communicating passage 105.

By providing the atmospheric pressure opening passage 107, even if oil and so forth enters the communication passage 104, it is possible to discharge the oil and so forth to the crank chamber 7 when a negative pressure is created in the crank chamber 7. It is because the air cleaner side opening 117 in the atmospheric pressure opening passage 107 opens in a space under atmospheric pressure. Therefore, when a negative pressure is created in the crank chamber 7, the air enters the crank chamber side opening 103 from the air cleaner side opening 117 to discharge the oil having flown into the communicating passage 104. Here, note that the pipeline resistance of the atmospheric pressure opening passage 107 should not be set too low in order to prevent the performance of the diaphragm fuel pump 109 from degrading. It is because too low pipeline resistance of the atmospheric pressure opening passage 107 causes a situation in which the air not in the diaphragm chamber 110 side but in the atmospheric pressure opening passage 107 side is sucked too much when a negative pressure is created in the crank chamber 7.

An air cleaner side orifice 111 is provided to set the pipeline resistance of the atmospheric pressure opening passage 107. This air cleaner side orifice 111 increases pipeline resistance. In order to increase pipeline resistance, there are several methods, for example, a method of setting the length of a pipeline long, a method of setting the entire pipeline thin, a method of folding a pipeline more than once and so forth. Here, combinations of the above-described methods are possible to provide a synergistic effect. In addition, the air cleaner side orifice 111 does not need to be always provided near the air cleaner side opening 117 because it is used to set pipeline resistance. For example, the air cleaner side orifice 111 may be provided in the center of the atmospheric pressure opening passage 107, the communicating passage 104 side and so forth.

A check valve 115 is provided in the crank chamber side opening 103, which is an exemplary flowback prevention part. This check valve 115 is configured to allow fluid (air) to move only in one direction from the diaphragm chamber 110 in the diaphragm fuel pump 109 to the crank chamber 7 which is an exemplary negative pressure part. Here, the shape of the check valve 115 as a flowback prevention part is not limited.

The atmospheric pressure opening passage 107 is open in the space (the cleaned side) after the air has passed through the filter 23 in the air cleaner 21. Therefore, it is possible to flow the cleaned air not containing dust and so forth into the atmospheric pressure opening passage 107.

Figure 2:
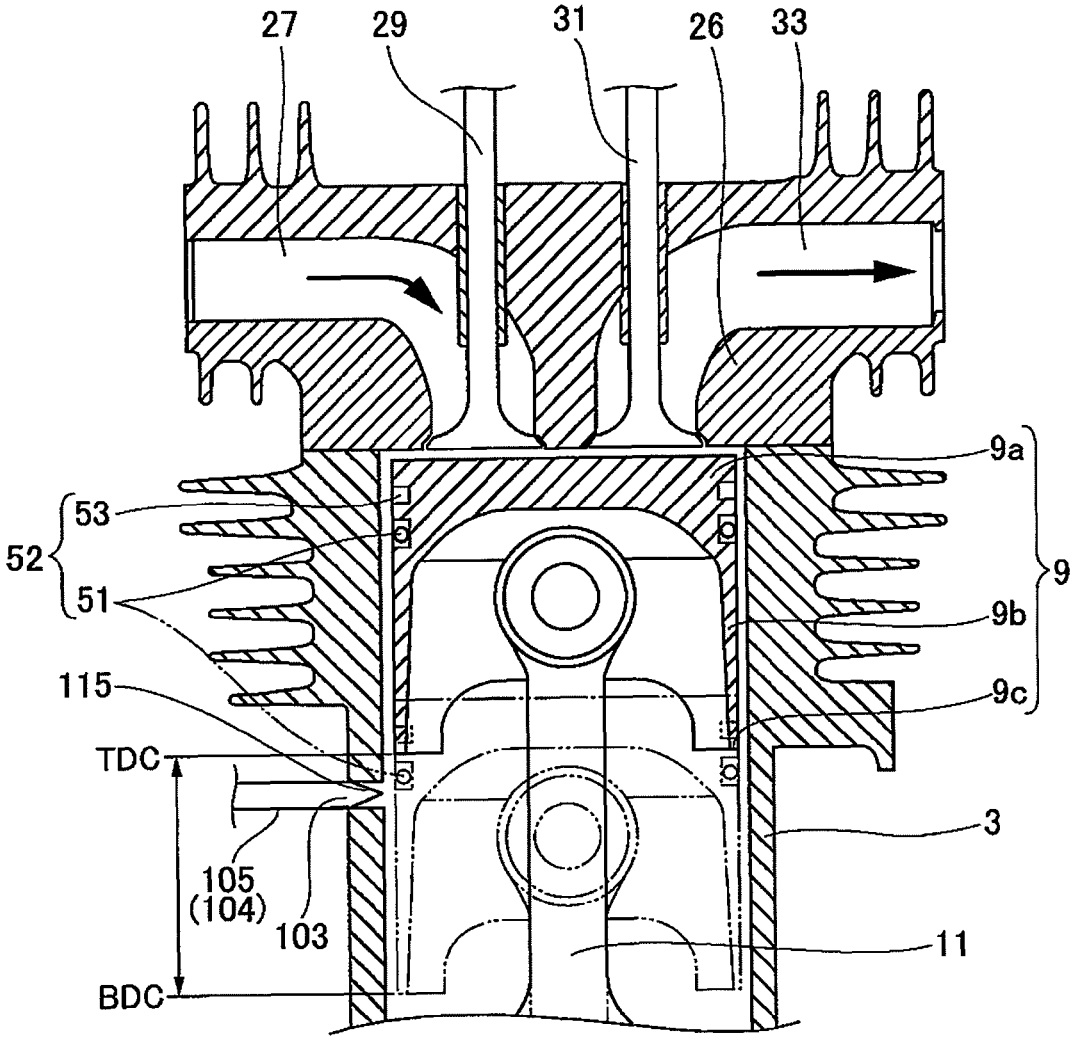
FIG. 2 is a drawing showing a crank chamber side opening.

FIG. 2 is a drawing showing the position of the crank chamber side opening 103. Here, in FIG. 2, the piston 9 located at TDC is indicated by the solid line, and the piston 9 located at BDC is indicated by the broken line.

Here, the piston 9 includes a piston head 9*a* and a skirt part 9*b* following the piston head 9*a*. A termination portion 9*c* is formed at the end of the skirt part 9*b* in the crank chamber 7 side.

With the present embodiment, as shown in FIG. 2, the crank chamber side opening 103 of the communicating passage 104 in the crank chamber 7 side is formed to open in the position in the vicinity of termination portion 9*c* of the skirt part 9*b* of the piston 9 when the piston 9 is located at TDC. This prevents oil and so forth from entering the communicating passage 104 and the diaphragm chamber 110 due to a positive pressure created in the crank chamber 7 (crankcase 5). Moreover, the crank chamber side opening 103 of the communicating passage 104 in the crank chamber 7 side is formed to open in the position closer to the crank axle 13*a* than the termination portion 9*c* when the piston 9 is located at TDC. By forming the crank chamber side opening 103 in this position, it is possible to close the communicating passage 104 when a positive pressure is created in the crank chamber 7, and to consequently supply substantially only a negative pressure to the communicating passage 104. Then, at the time the negative pressure in the crank chamber is maximized (minimized), the crank chamber side opening 103 can open, and therefore it is possible to provide a pulsed negative pressure to the diaphragm chamber 110. By this means, it is possible to reliably drive the diaphragm fuel pump 109.

An annular piston ring 52 is fitted into a portion of the side surface of the piston 9 in the combustion chamber 8 side. This piston ring 52 is formed by a compression ring 53 and an oil ring 51. The compression ring 53 needs to always be tightly attached to the cylinder part 3 because it is provided to separate the combustion chamber 8 from the crank chamber 7. In addition, the compression ring 53 needs to lubricate to prevent abrasion because it slidably moves. Therefore, there is much more oil in the gap portion between the cylinder part 3 and the piston 9 in the combustion chamber 8 side than in the region between the compression ring 53 and the oil ring 51. By the way, when the four-stroke engine 1 according to the present invention is applied to a working machine such as a brush cutter and a chain saw whose body posture is changed significantly, the communicating passage 104 may be located in the lower side of the engine body in working condition. In addition, a case is possible where the user leaves the working machine while the communicating passage 104 is located in the lower side. This causes a problem that the diaphragm 108 of the carburetor 25 does not normally operate because oil enters the carburetor 25 via the communication passage 104. The present invention aims to prevent this problem by means of the check valve 115 described later, as an exemplary flowback prevention part.

If the crank chamber side opening 103 is formed in the position apart from the oil ring 51 in the piston 9 when the piston 9 is located at BDC, it is required to increase the length of the skirt part 9*b* accordingly, and consequently to increase the size of the piston 9. Therefore, with the present embodiment, the crank chamber side opening 103 is formed in the vicinity of the oil ring 51 in the piston 9 when the piston 9 is located at BDC to reduce the size of the piston 9 and prevent oil from collecting in the crank chamber side opening 103.

Here, as shown in FIG. 2, the atmospheric pressure opening passage 107 is essential for the present embodiment where the crank chamber side opening 103 is located in the vicinity of the termination portion 9*c* of the skirt part 9*b* of the piston 9 when the piston 9 is located at TDC. That is, the diaphragm fuel pump 109 cannot exhibit satisfactory performance without the atmospheric pressure opening passage 107 even if a negative pressure is applied to the communicating passage 104. It is because the crank chamber side opening 103 is closed by the skirt part 9*b* before the pressure returns to a positive pressure after the piston 9 has arrived at TDC and the pressure in the communicating passage 104 has been minimized. This causes a situation in which the pressure in the communicating passage 104 keeps a certain negative pressure, and therefore it is not possible to generate sufficient pressure fluctuation. Then, when the piston 9 arrives at TDC at the next stroke, the pressure can only change from the certain negative pressure to the minimum pressure. The diaphragm fuel pump 109 is driven depending on the magnitude of pressure fluctuation, and therefore cannot work if the magnitude of pressure fluctuation is small. Therefore, with the present embodiment, a configuration is adopted where the atmospheric pressure opening passage 107 is provided and the air is supplied to the communicating passage 104 while the crank chamber side opening 103 is closed by the skirt part 9*b* of the piston 9 to make the pressure fluctuation in the diaphragm chamber 110 greater. Here, with the configuration according to the present embodiment, the period of time over which the crank chamber side opening 103 is closed is substantially longer than the period of time over which the crank chamber side opening 103 is open. Therefore, even if the pipeline resistance of the atmospheric pressure opening passage 107 increases to some extent, it is possible to supply a sufficient amount of the air to the communicating passage 104. By this means, it is possible to generate a sufficient magnitude of pressure fluctuation in the communicating passage 104.

Here, with the present invention, by providing the flowback prevention part (check valve 115), the crank chamber side opening 103 does not need to be located in the vicinity of the termination portion 9*c* of the skirt part 9*b* of the piston 9 when the piston 9 is located at TDC. However, by providing the crank chamber side opening 103 at the position shown in FIG. 2, it is possible to apply a pulsed negative pressure to the diaphragm chamber 110 via the communicating passage 104. The reason why the crank chamber side opening 103 is provided at this position is that the crank chamber side opening 103 is covered with the skirt part 9*b* of the piston 9 until the piston 9 arrives at the vicinity of TDC even if a negative pressure is created in the crank chamber 7. Then, when the piston 9 arrives at the vicinity of TDC, the negative pressure in the crank chamber 7 is maximized (minimized). In this state, the skirt part 9*b* having covered the crank chamber opening 103 moves, and is removed. As a result, a pulsed negative pressure is applied to the diaphragm chamber 110 via the communicating passage 104. For this reason, with Embodiment 1, it is possible to drive the diaphragm fuel pump 109 powerfully. However, the position of the crank chamber side opening 103 is not limited to this, but the diaphragm fuel pump 109 can be driven as long as the crank chamber side opening 103 is located in a place in which a negative pressure is created.

Figure 3:
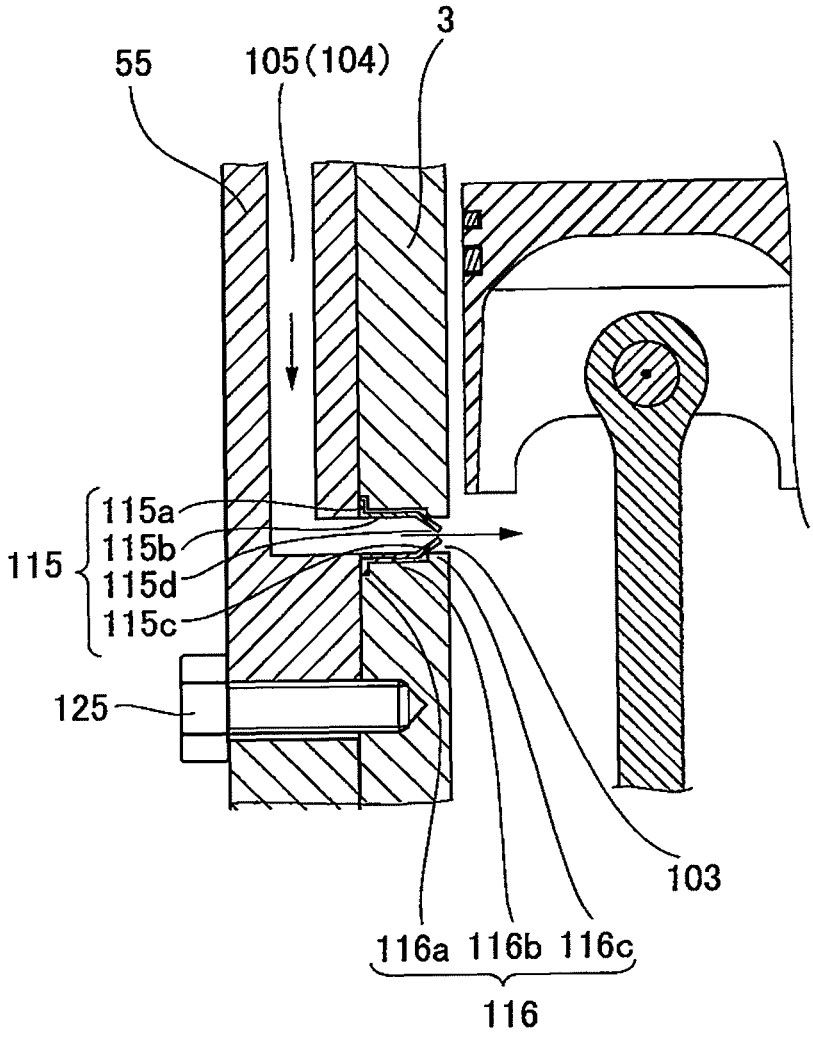
FIG. 3 is a drawing showing the configuration of a check valve.

FIG. 3 is a drawing showing the configuration of the check valve 115.

As shown in FIG. 3, it is preferable to form the communicating passage 104 in a side member 55. This side member 55 allows the communicating passage 104 to be formed, and also allows the check valve 115 to be positioned at a predetermined position. Moreover, various passages that allow, for example, oil, fuel, air and blowby gas to flow through may be formed in the side member 55. Moreover, the side member 55 may function to hold the carburetor 25, the air cleaner 21 and so forth. In addition, the side member 55 may be formed integrally with the carburetor 25, the air cleaner 21 and so forth.

The cylinder part 3 includes a first cylindrical space 116*a*, a second cylindrical space 116*b* and a third cylindrical space 116*c* to arrange them from the outer periphery to the center in this order as shown in FIG. 3. The diameter of the first cylindrical space 116*a* is greater than that of the second cylindrical space 116*b*. The diameter of the second cylindrical space 116*b* is greater than that of the third cylindrical space 116*c*. The first cylindrical space 116*a*, the second cylindrical space 116*b* and the third cylindrical space 116*c* are formed concentrically.

The check valve 115 includes a first elastic member 115*a*, a second elastic member 115*b* and a third elastic member 115*c*. The first elastic member 115*a* is a disc-like member having the central cavity. The first elastic member 115*a* is provided to fix the check valve 115 to a predetermined position. This first elastic member 115*a* is disposed in the first cylindrical space 116*a*. The second elastic member 115*b* is formed as a cylinder. This second elastic member 115*b* is disposed in the second cylindrical space 116*b*. The third elastic member 115*c* inclines upward and downward as shown in FIG. 3. A check valve opening 115*d* is formed between the upper end and the lower end of the third elastic member 115*c* to be open in the horizontal direction. With this configuration, the check valve 115 allows fluid to move only in one direction from the diaphragm chamber 110 to the cylinder part 3.

The first cylindrical space 116*a* is formed to accommodate the first elastic member 115*a*. To be more specific, the height of the first cylindrical space 116*a* is smaller than that of the first elastic member 115*a*. Therefore, the first elastic member 115*a* can be shrunk to be sandwiched between the outer wall of the side member 55 in the cylinder part 3 side and the inner wall of the first cylindrical space 116*a* of the cylinder part 3. As a result, the check valve 115 can be positioned and fixed onto a predetermined position.

The check valve 115 is disposed in the cylinder part 3, and therefore needs to have heat resistance. Moreover, the check valve 115 also needs to have oil resistance because there is oil in the cylinder part 3. Here, due to the structure of the check valve, at least part of the member constituting the check value 115, to be more specific, the third elastic member 115*c*, needs to have elasticity. The structure of the check valve 115 is not limited to this. A poppet valve, a swing valve, a wafer valve, a lift valve, a ball valve and a foot valve are possible.

The side member 55 is attached to the cylinder part 3 with a bolt member 125. By this means, it is possible to readily position and fix the side member 55 onto a predetermined position of the cylinder part 3. As a result, it is possible to readily position and fix the check valve 115. As a result, the four-stroke engine 1 can be more simply assembled. Here, the bolt member 125 is not limited to a bolt as long as the side member 55 can be positioned and fixed onto a predetermined position of the cylinder part 3.

Figure 4:
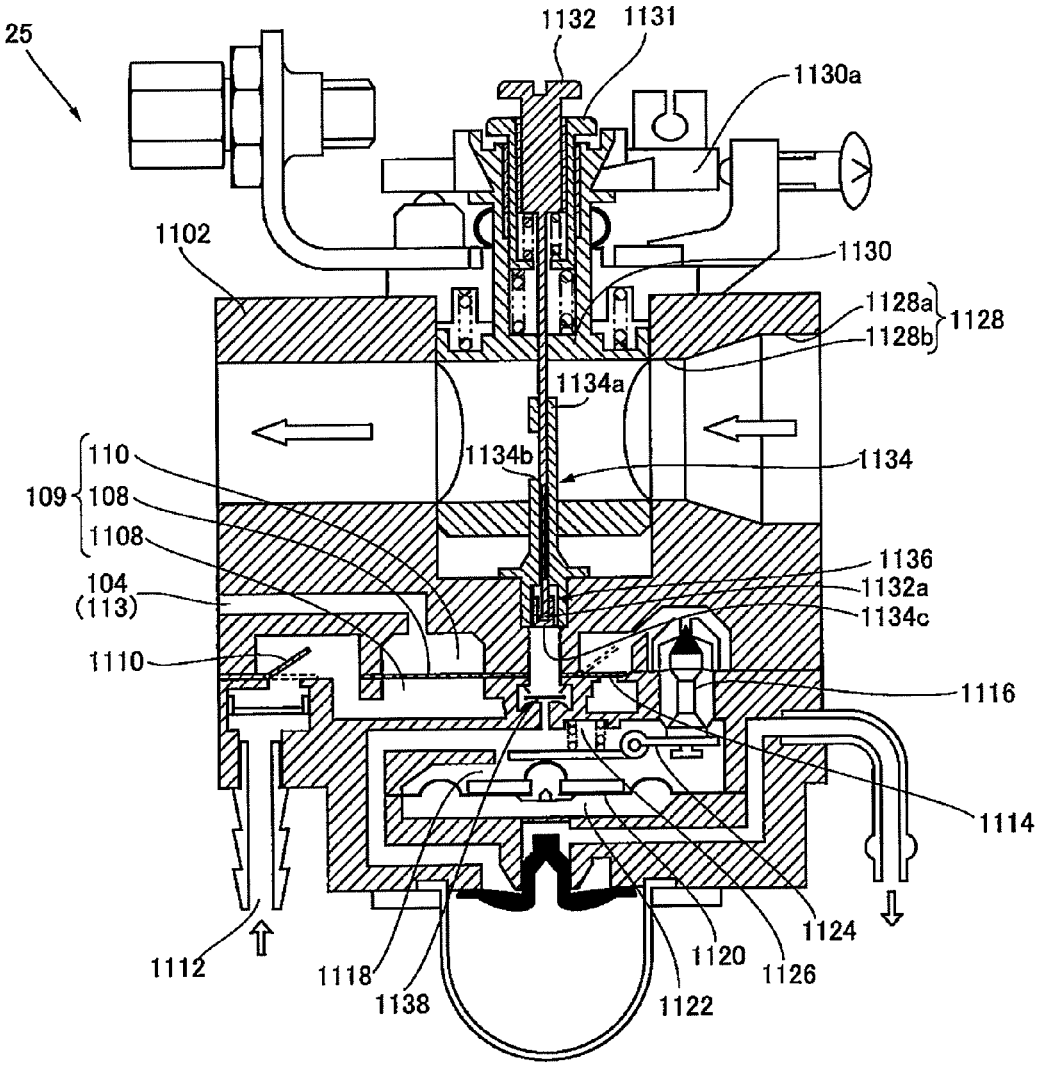
FIG. 4 is a drawing showing the configuration of a carburetor to which a diaphragm fuel pump is applied.

FIG. 4 is a drawing showing the configuration of the carburetor 25 to which the diaphragm fuel pump 109 is applied.

As shown in FIG. 3, the carburetor 25 includes a carburetor body 1102. The communicating passage 104 which allows communication with the crank chamber 7, is formed in the carburetor body 1102. This communicating passage 104 faces the diaphragm chamber 110, which is one side (the upper part in the figure) of the diaphragm fuel pump 109. A pump chamber 1108 is formed in the other side (the lower part in the figure) of the diaphragm fuel pump 109. A fuel inlet 1112 communicates with the pump chamber 1108 via an inlet valve 1110, and a metering chamber 1118 in a metering diaphragm 1120 communicates with the pump chamber 1108 via an outlet valve 1114 and a needle valve 1116. Here, the fuel inlet 1112 is connected to a fuel tank (not shown). The crank chamber side opening 103 of the communicating passage 104 in the crank chamber 7 side is formed in the cylinder part 3 which defines the crank chamber 7.

The pressure in the crank chamber 7 varies according to a change in its volume. As described above, only a negative pressure of the varying pressure affects the diaphragm chamber 110 via the communicating passage 104. Then, the diaphragm fuel pump 109 is driven by the negative pressure affecting the diaphragm chamber 110. To be more specific, a negative pressure affects the diaphragm chamber 110 in the diaphragm fuel pump 109, and therefore the negative pressure affects the pump chamber 1108 side when the diaphragm 108 bends to the diaphragm chamber 110 side. The negative pressure in the pump chamber 1108 allows the inlet valve 1110 to open while the outlet valve 1114 is closed, and therefore fuel is sucked from the fuel inlet 1112 into the pump chamber 1108. Next, in this state, when the negative pressure affecting the diaphragm chamber 110 in the diaphragm fuel pump 109 changes to a positive pressure, the elastic force of the diaphragm 108 forces the diaphragm 108 to return to the original state. Therefore, a positive pressure affects the pump chamber 1108 side. Then, when the motion of the diaphragm 108 causes the positive pressure to affect the pump chamber 1108 side, the outlet valve 1114 opens while the inlet valve 1110 remains closed to discharge the fuel from the pump chamber 1108. This discharged fuel is supplied to the metering chamber 1118 in the metering diaphragm 1120 via the needle valve 1116.

The metering chamber 1118 is separated from a back pressure chamber 1122 by the metering diaphragm 1120. The pressure of the four-stroke engine 1 affects the back pressure chamber 1122. The metering diaphragm 1120 is driven by the difference in pressure between the four-stroke engine 1 and the metering chamber 1118. Here, a passage is not shown in the figure, which allows communication between the back pressure chamber 1122 and the space under a negative pressure in the engine. The metering diaphragm 1120 is connected to the above-described needle valve 1116 via a control lever 1124, and operates to open and close the needle valve 1116. To be more specific, when the metering chamber 1118 is filled with fuel, the pressure in the metering chamber 1118 rises and the metering diaphragm 1120 bends to the back pressure chamber 1122 side. At this time, the elastic force of a control lever spring 1126 causes the control lever 1124 to rotate such that one end (the left side in the figure) of the control lever 1124 is pushed down and the other end (the right side in the figure) is pushed up. This rotation of the control lever 1124 causes the needle valve 1116 to pushup and breaks the communication between the pump chamber 1108 and the metering chamber 1118.

A passage 1128 is formed in the carburetor body 1102 to connect between the intake port 27 formed in the cylinder part 3 and the air cleaner 21. This passage 1128 has a large diameter part 1128*a* in the upper stream side (the air cleaner 21 side) and a smaller venturi part 1128*b* in the downstream side (the intake port 27 side) than the large diameter part 1128*a*. The venturi part 1128*b* includes a throttle valve 1130 to change its opening. The axis of rotation of the throttle valve 1130 is orthogonal to the passage 1128. By operating a rotating lever 1130*a*, the throttle valve 1130 rotates, sliding upward and downward in the figure to change the opening of the venturi part 1128*b* according to the degree of rotation.

In addition, this throttle valve 1130 is provided with a first adjuster screw 1131 which is coaxial with the axis of the rotation of the throttle valve 1130 to fine-tune the amount of fuel mixed into the air flowing through the passage 1128. This first adjuster screw 1131 is provided with a second adjuster screw 1132 which is coaxial with the axis of rotation of the first adjuster screw 1131. The second adjuster screw 1132 is provided to extend upward and downward in the figure. The outer diameter of the second adjuster screw 1132, which is approximately the same as the inner diameter of the nozzle 1134 described later, reduces from the top to the bottom in two steps. A switching part 1132*a* to switch a main jet 1136 described later is provided on the tip of the second adjuster screw 1132. In the figure, the first adjuster screw 1131 moves downward, rotating in one direction (to tighten the screw) with respect to the throttle valve 1130, and, on the other hand, moves upward, rotating in the other direction (to loosen the screw) with respect to the throttle valve 1130. Likewise, in the figure, the second adjuster screw 1132 moves downward, rotating in one direction (to tighten the screw) with respect to the first adjuster screw 1131, and, on the other hand, moves upward, rotating in the other direction (to loosen the screw) with respect to the first adjuster screw 1131.

The nozzle 1134 is provided in the carburetor body 1102 to face the second adjuster screw 1132. The tip of the second adjuster screw 1132 is inserted into a nozzle tip 1134*a* of the nozzle 1134. In addition, the nozzle 1134 includes a hole 1134*b* which is open in the passage 1128. A bottom 1134*c* in communication with the hole 1134*b* faces the metering chamber 1118. Here, the main jet 1136 and a main check valve 1138, which serve as a mixture ratio adjusting means and fuel adjusting mechanism, are provided between the hole 1134*b* and the metering chamber 1118.

Figure 5:
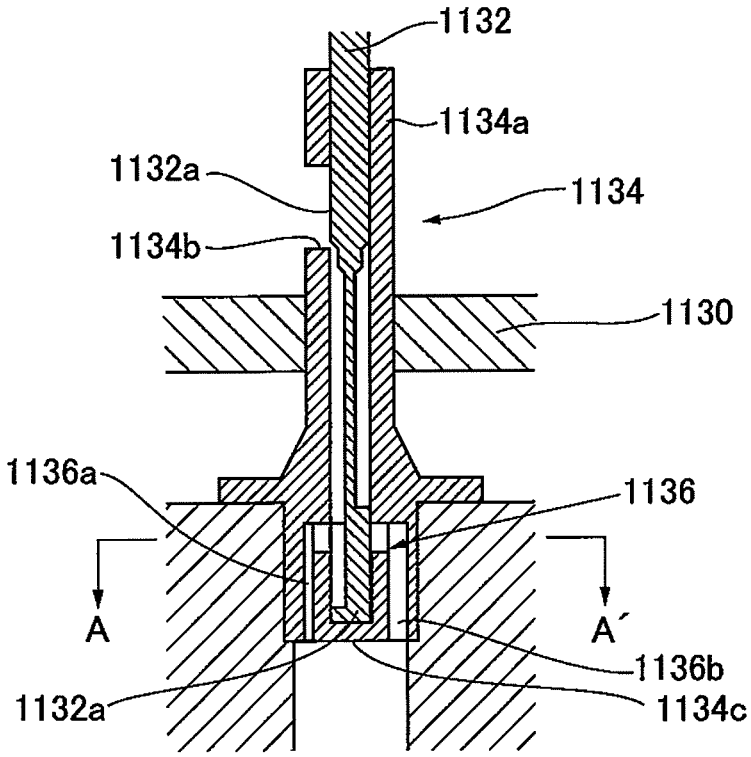
FIG. 5 is a drawing showing a nozzle.

FIG. 5 is a drawing showing the nozzle 1134. Here, FIG. 6 is a cross sectional view of FIG. 5 taken along line A-A' of FIG. 5.

Figure 6:
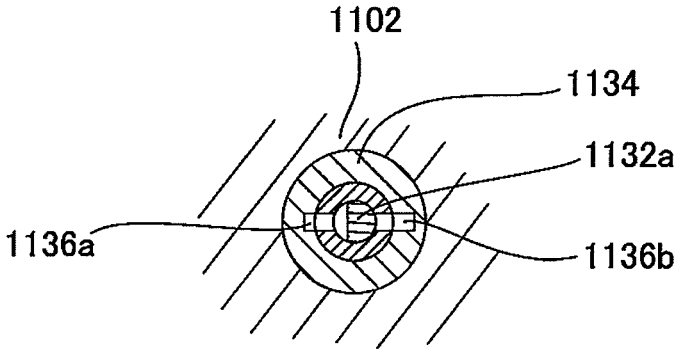
FIG. 6 is a cross sectional view of FIG. 5 taken along line A-A.

As shown in FIG. 5 and FIG. 6, the main jet 1136 includes a first main jet part 1136*a* and a second main jet part 1136*b*. The first main jet part 1136*a* has a predetermined opening area to allow communication between the hole 1134*b* of the nozzle 1134 and the metering chamber 1118. The second main jet part 1136*b* has a lager opening area than of the first main jet part 1136*a* to allow communication between the hole 1134*b* of the nozzle 1134 and the metering chamber 1118. One of the first main jet part 1136*a* and the second main jet part 1136*b* of the main jet 1136 is closed by the switching part 1132*a* in the second adjuster screw 1132, and the other allows communication between the hole 1134*b* of the nozzle 1134 and the metering chamber 1118. By rotating the second adjuster screw 1132 with respect to the first adjuster screw 1131, it is possible to switch between open and close of the first main jet part 1136*a* and the second main jet part 1136*b* of the main jet 1136. That is, by rotating the second adjuster screw 1132 with respect to the first adjuster screw 1131 according to fuel to be used, it is possible to deliver fuel to one of the first main jet part 1136*a* and the second main jet part 1136*b* of the main jet 1136.

Figure 7:
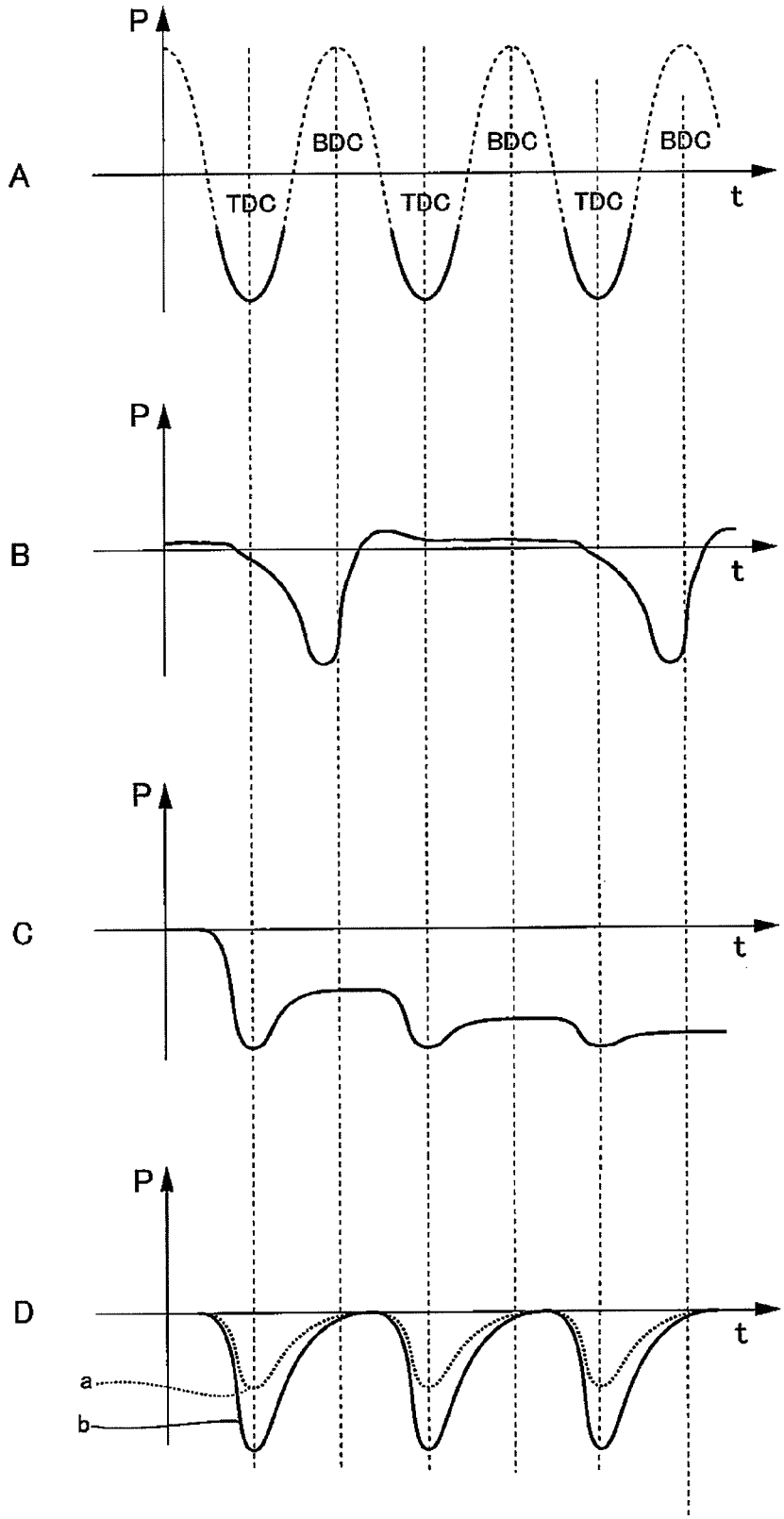
FIG. 7 is a drawing explaining the effects of Embodiment 1.

FIG. 7 is a drawing showing an effect of the present embodiment.

As the piston 9 reciprocates between TDC and BDC, the pressure in the crank chamber 7 fluctuates as shown in the solid line and the broken line in FIG. 7A. On the other hand, the pressure in the intake port 27 changes only once while the crank axle 13*a* rotates twice as shown in FIG. 7B. Therefore, it is not appropriate to use the pressure in the intake port 27 as the power source for the diaphragm fuel pump 109. As the configuration with the present embodiment, the crank chamber side opening 103 of the communicating passage 104 in the crank chamber 7 side is formed to open in the position near the position in which the termination portion 9*c* of the skirt part 9*b* of the piston 9 is located when the piston 9 is located at TDC. By this means, the pressure in the crank chamber 7 acts near the crank chamber side opening 103 as shown in the solid line in FIG. 7A. However, in this configuration, if there is no atmospheric pressure opening passage 107, the pressure in the communicating passage 104 can only fluctuate as shown in FIG. 7C. Under such a circumstance, the diaphragm fuel pump 109 cannot work satisfactorily because it is driven depending on the magnitude of pressure fluctuation. To solve this problem, the atmospheric pressure opening passage 107 is connected to the communicating passage 104 to allow the air in the space under atmospheric pressure to be supplied to the communicating passage 104. By this means, the pressure in the communicating passage 104 is returned to nearly atmospheric pressure, so that it is possible to make pressure fluctuation greater as shown in FIG. 7D. Here, broken line a shown in FIG. 7D shows the pressure fluctuation in a case in which the air cleaner side orifice 111 is not provided in the air cleaner side opening 117 of the atmospheric pressure opening passage 107. Meanwhile, solid line b shown in FIG. 7D shows the pressure fluctuation in a case in which the air cleaner side orifice 111 is provided in the air cleaner side opening 117 of the atmospheric pressure opening passage 107. As described above, by providing the air cleaner side orifice 111, it is possible to adequately increase the pipeline resistance of the atmospheric opening passage 107 to prevent the air from being sucked more than necessary from the atmospheric pressure opening passage 107 when the crank chamber 7 and the communicating passage 104 communicate with one another. Here, the air cleaner side orifice 111 is not always required, but a case is possible where the pipeline is thinned, lengthened, bent and the like to control pipeline resistance. However, with the above-described methods, it is not easy to control pipeline resistance. Therefore, it is preferable to provide the air cleaner side orifice 111.

Moreover, by providing the atmospheric pressure opening passage 107, it is possible to discharge oil and so forth having entered the communicating passage 104. Here, for this, it is preferable to increase a speed at which the air flows from the atmospheric pressure opening passage 107 to the communicating passage 104.

Embodiment 2

Figure 8:
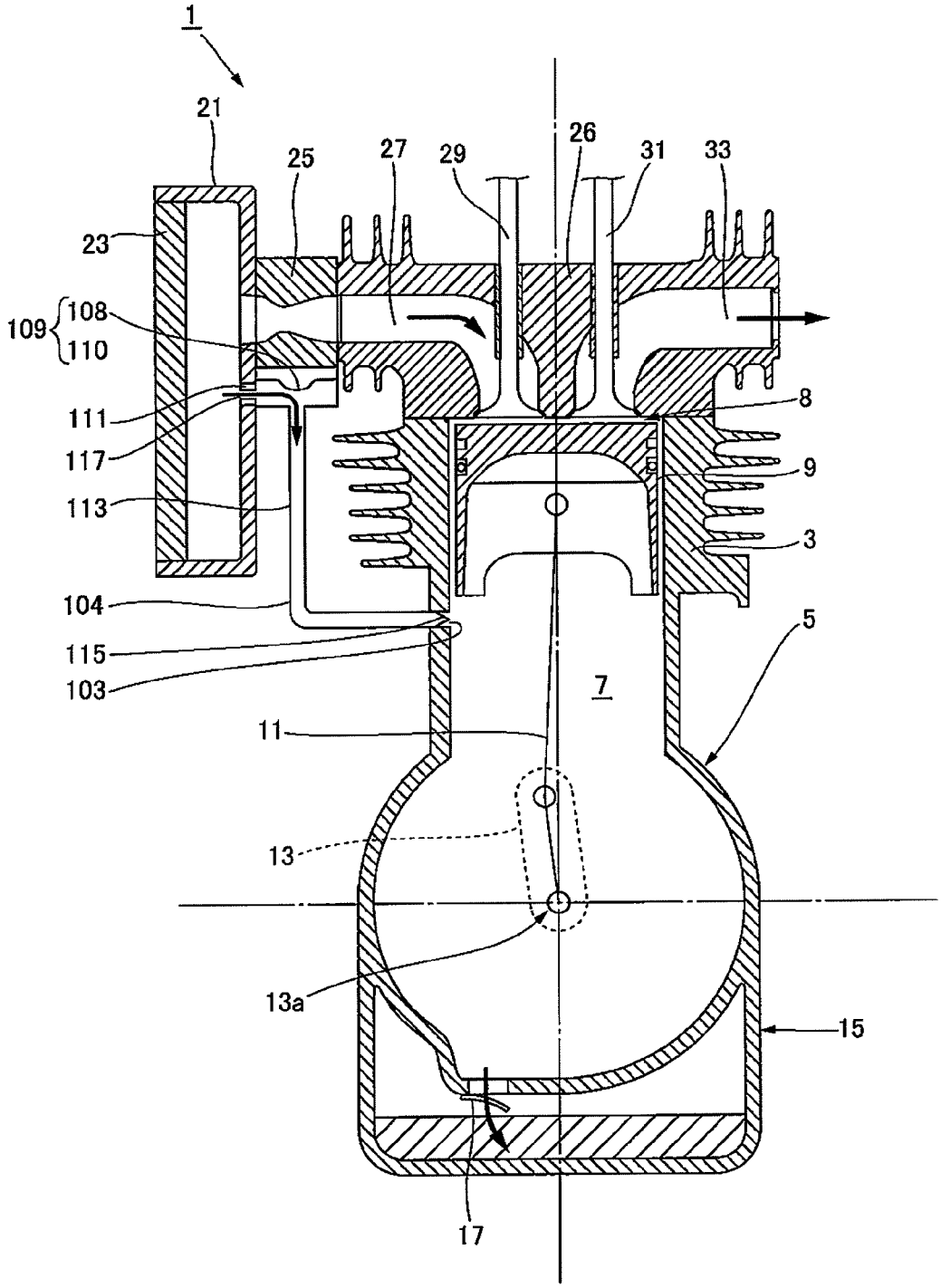
FIG. 8 is a schematic view showing the four-stroke engine according to Embodiment 2 of the present invention.
Figure 9:
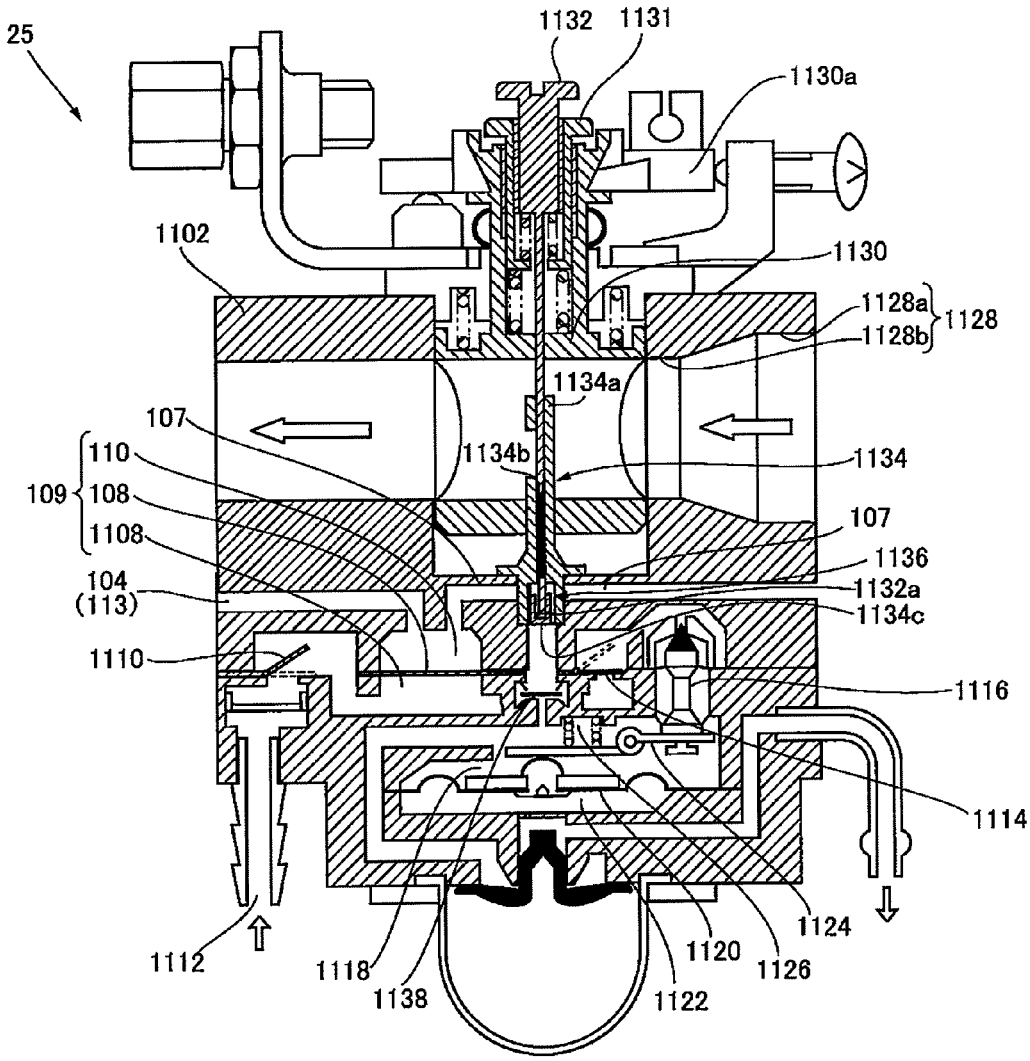
FIG. 9 is a drawing to give a detailed description of the four-stroke engine according to Embodiment 2.

FIG. 8 is a schematic view showing the four-stroke engine according to Embodiment 2 of the present invention. FIG. 9 is a drawing to give a detailed description of the four-stroke engine according to Embodiment 2.

The atmospheric pressure opening passage 107 does not communicate with the communicating passage 104 but communicates with the diaphragm chamber 110 in the diaphragm fuel pump 109. Here, in this case, it is preferable to provide the air cleaner side orifice 111 in the air cleaner side opening 117 of the atmospheric pressure opening passage 107.

As shown in FIG. 9, the atmospheric pressure opening passage 107 is formed in the carburetor 25. This atmospheric pressure opening passage 107 is connected to the air cleaner 21 side, and therefore easily communicates with the air cleaner 21.

Embodiment 3

Figure 10:
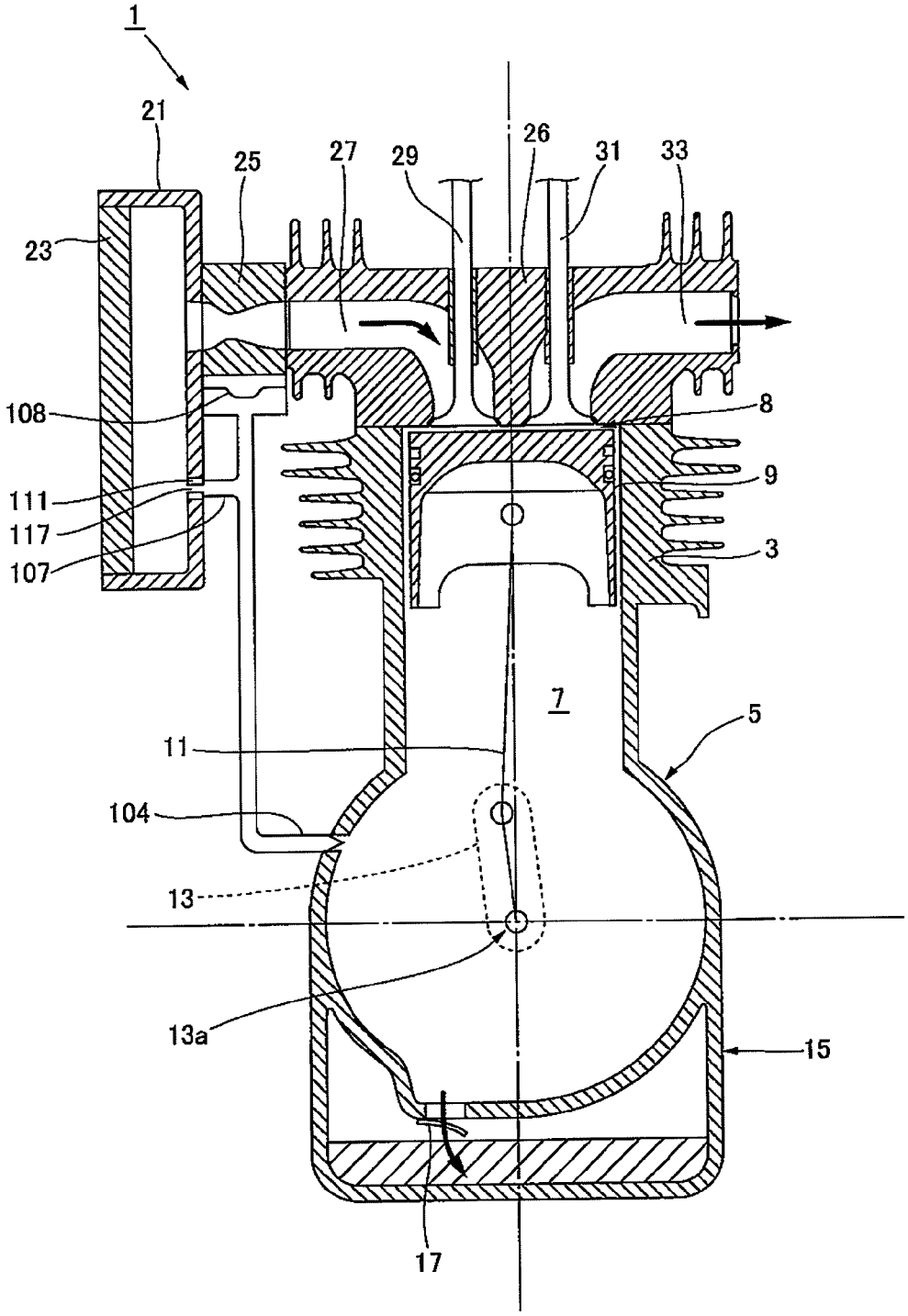
FIG. 10 is a schematic view showing the four-stroke engine according to Embodiment 3 of the present invention.

FIG. 10 is a schematic view showing the four-stroke engine according to Embodiment 3 of the present invention.

As shown in FIG. 10, a configuration is possible where the communicating passage 104 is provided to directly communicate with the crankcase 5. By this configuration, it is possible to provide a mechanism that drives the diaphragm fuel pump 109 with a simpler structure.

Embodiment 4

With the above-described embodiments, the communicating passage 104 is open in the cylinder part 3 or the crankcase 5. However, with the present invention, the location where the communicating passage 104 is open is not limited. The communicating passage 104 may be open, for example, in the intake port 27 as long as the communicating passage 104 is formed in a place in which a negative pressure is applied. Alternatively, the communicating passage 104 may be open in any negative pressure part in the four-stroke engine 1.

Embodiment 5

Figure 11:
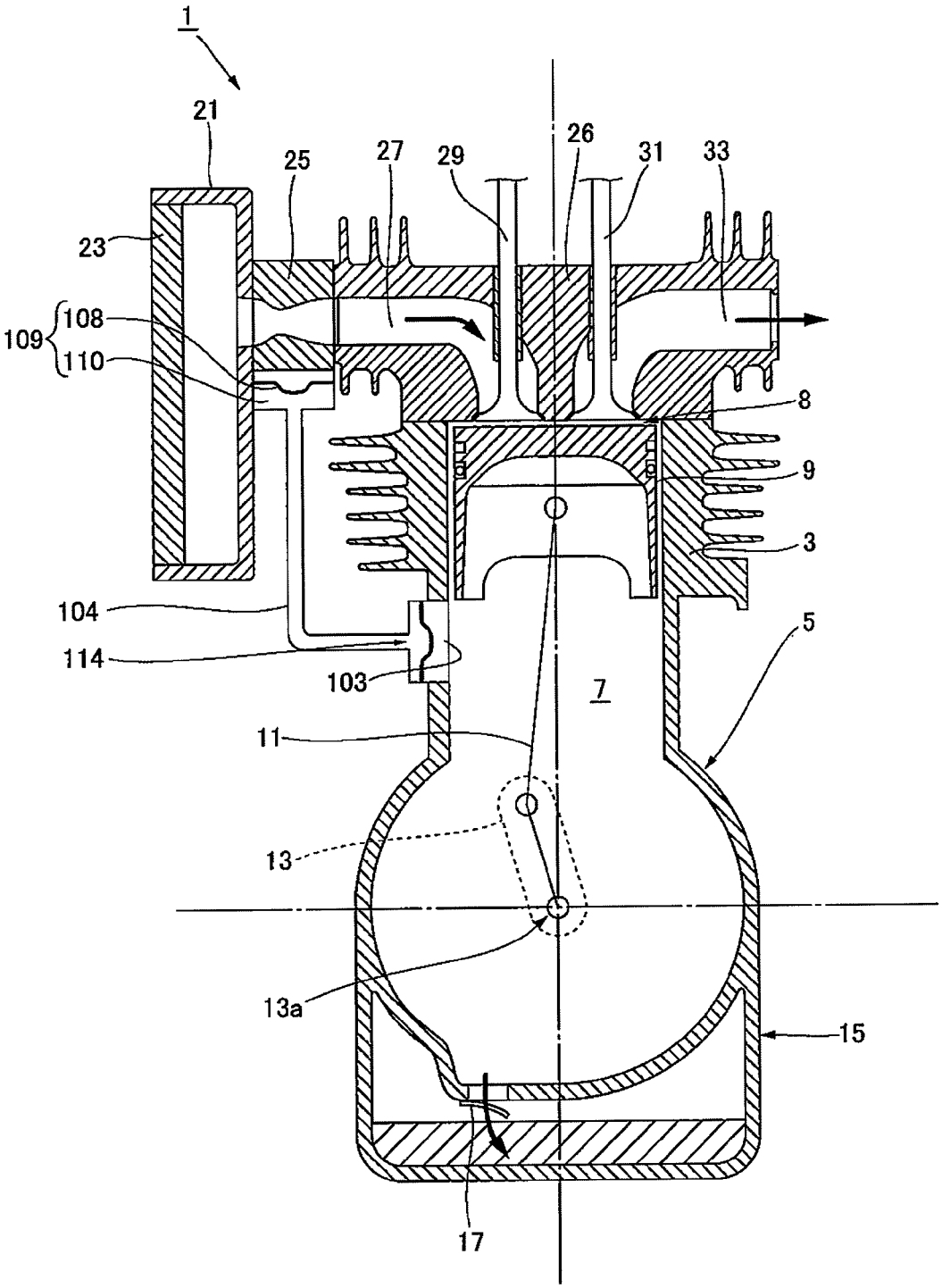
FIG. 11 is a schematic view showing the four-stroke engine according to Embodiment 5 of the present invention.

Now, the four-stroke engine 1 according to Embodiment 5 of the present invention will be explained with reference to FIG. 11. FIG. 11 is a schematic view showing the four-stroke engine according to Embodiment 5 of the present invention. Here, FIG. 11 shows the four-stroke engine 1 in a state in which the piston 9 is located in the vicinity of TDC.

As shown in FIG. 11, the four-stroke engine 1 includes the cylinder part 3, the crankcase 5 mounted under the cylinder part 3 and the oil tank 15 provided below the crankcase 5. The cylinder part 3 has the cylindrical space to slidably move the piston 9 upward and downward in FIG. 11. Then, the piston 9 is fitted into the space with a gap to slidably move upward and downward in FIG. 11. The crank chamber 7 is defined by the cylinder part 3, the crankcase 5 and the piston 9. That is, the crank chamber 7 is an approximately cylindrical space defined by the side surface of the cylinder part 3, the piston 9 and the crankcase 5. The volume of the inner space of this crank chamber 7 varies as the piston 9 slidably moves. The combustion chamber 8 is defined by the cylinder head 26, the cylinder part 3 and the piston 9. The oil tank 15 to store oil is provided separately from the crankcase 5.

A crank chamber crank chamber check valve 17 is provided between the oil tank 15 and the crankcase 5 to allow oil to flow only in the direction from the crankcase 5 (crank chamber 7) to the oil tank 15. Here, a negative pressure is created in the crank chamber 7 as the piston 9 moves from the bottom dead center (BDC) to TDC. By contrast with this, a positive pressure is created in the crank chamber 7 as the piston 9 moves from TDC to BDC. Although a negative pressure is easily created in the crank chamber 7 because the crank chamber check valve 17 is provided, the pressure in the crank chamber 7 can rise only up to a positive pressure that overcomes the elasticity of a spring and so forth used in the crank chamber check valve 17. Then, the elasticity of a spring and so forth used in the crank chamber check valve 17 is relatively poor, so that the pressure in the crank chamber can only increase to a positive pressure a little. The crank chamber 7 is a negative pressure part because a negative pressure is created in the crank chamber 7 when the piston 9 moves from BDC to TDC. Here, the pressure in the crank chamber 7 changes once while the crank axle 13*a* rotates once. This is different from the pressure in an intake port or an exhaust port, which changes only once while the crank axle 13*a* rotates twice.

The crank 13 is rotatably supported in the crankcase 5. This crank 13 is formed by the crank axle 13*a* which is the center of rotation, counterweight and so forth. The piston 9 and the crank 13 are connected one another via the connecting rod 11. The connecting rod 11 is rotatably connected to both the piston 9 and the crank 13. This configuration allows the piston 9 to reciprocally and slidably move in the cylinder part 3.

The cylinder head 26 is provided on the upper wall of the cylinder part 3. The cylinder head 26 is provided with the intake port 27 that allows communication with the carburetor 25 and the exhaust port 33 that allows communication with the exhaust muffler (not shown). The cylinder head 26 is also provided with the intake valve 29 to open and close the intake port 27. In addition, the cylinder head 26 is provided with the exhaust valve 31 to open and close the exhaust port 33. A negative pressure is created in the intake port every time the intake valve 29 opens and closes. Therefore, also the intake port 27 is a negative pressure part. In addition, the crank chamber 7 may be a negative pressure part. The four-stroke engine 1 also has a positive pressure part 4 such as the exhaust port 33 in which a positive pressure is created every time the exhaust valve 31 opens and closes. Then, the negative pressure part, the positive pressure part, and part in which both a positive pressure and a negative pressure are created alternatively, are collectively referred to as a pressure fluctuation part.

The air cleaner 21 is provided outside the carburetor 25. The filter 23 is disposed in the air cleaner 21. The filter 23 allows air to pass through to remove dust and so forth in the air.

The carburetor 25 is an apparatus to mix fuel into the air having passed through the air cleaner 21. To be more specific, the carburetor 25 can control mixing of the air and fuel and also control the total amount of the air-fuel mixture. The carburetor 25 has the diaphragm fuel pump 109 to mix fuel into the air. This diaphragm fuel pump 109 is driven using pressure fluctuation as power.

With the present embodiment, in order to supply power to drive the diaphragm fuel pump 109, the diaphragm chamber 110 in the diaphragm fuel pump 109 is connected to a pressure applying part 114 via the communicating passage 104 to supply power. The pressure applying part 114 is open from the crank chamber opening 103 into the crank chamber 7. Here, the diaphragm fuel pump 109 is provided with a diaphragm 108 whose position changes in response to pressure fluctuation. Although with Embodiment 5, the communicating passage 104 is open in the cylinder part 3, it is by no means limiting but the communicating passage 104 may be open in a negative pressure part. When the communicating passage 104 is open in the cylinder part 3 via the pressure applying part 114, it is advantageous to supply a pulsed negative pressure to the diaphragm fuel pump 109. This will be described later.

Figure 12:
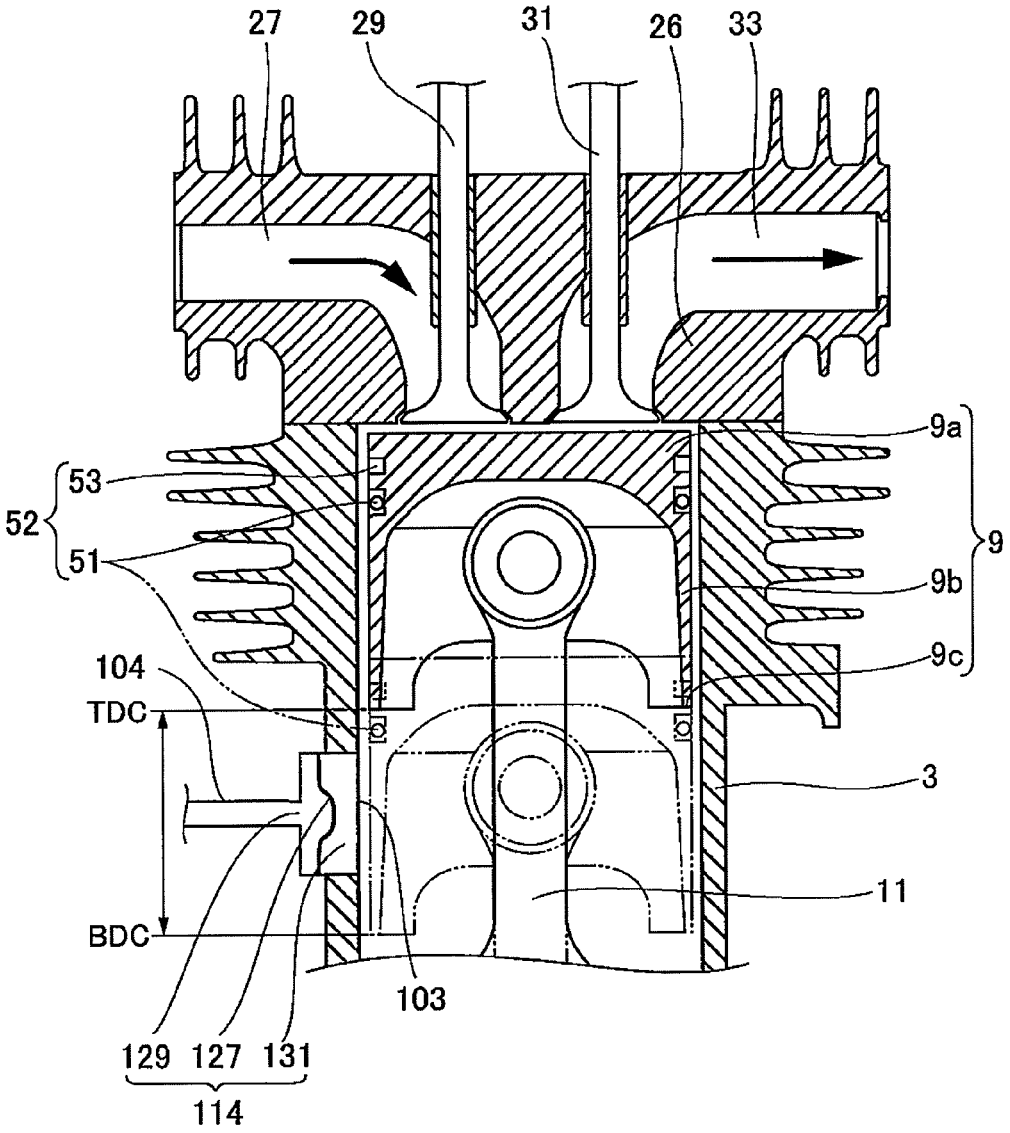
FIG. 12 is a drawing showing the crank chamber side opening.

FIG. 12 is a drawing showing the crank chamber side opening 103. Here, in FIG. 12, the piston 9 located at TDC is indicated by the solid line, and the piston 9 located at BDC is indicated by the broken line.

The pressure applying part 114 includes an elastic film 127, a first chamber 131 and a second chamber 129. The first chamber 131 is open into the cylinder part 3 via the crank chamber side opening 103. The second chamber 129 is connected directly to the communicating passage 104. Therefore, the second chamber 129 communicates with the diaphragm chamber 110 (see FIG. 11). By this means, the pressure in the second chamber 129 is transmitted as is. The elastic film 127 is formed not to allow fluid to flow through and can vibrate not a little, like the diaphragm 108 (see FIG. 14) of the diaphragm fuel pump 109. For example, the elastic film 127 may be made of an elastic member such as rubber. Moreover, the elastic film 127 may be a metal film or a plastic film having a bellows structure.

Here, the piston 9 includes the piston head 9*a* and the skirt part 9*b* following the piston head 9*a*. The termination portion 9*c* is formed at the end of the skirt part 9*b* in the crank chamber 7 side.

With the present embodiment, as shown in FIG. 12, the crank chamber side opening 103 of the communicating passage 104 in the crank chamber 7 side is formed to open in the position in the vicinity of termination portion 9*c* of the skirt part 9*b* of the piston 9 when the piston 9 is located at TDC. Moreover, the crank chamber side opening 103 of the communicating passage 104 in the crank chamber 7 side is formed to open in the position closer to the crank axle 13*a* than the termination portion 9*c* when the piston 9 is located at TDC. By forming the crank chamber side opening 103 in this position, it is possible to close the communicating passage 104 when a positive pressure is created in the crank chamber 7, and to consequently supply substantially only a negative pressure to the communicating passage 104. Then, at the time the negative pressure in the crank chamber is maximized (minimized), the crank chamber side opening 103 can open, and therefore it is possible to provide a pulsed negative pressure to the diaphragm chamber 110. By this means, it is possible to reliably drive the diaphragm fuel pump 109.

The annular piston ring 52 is fitted into a portion of the side surface of the piston 9 in the combustion chamber 8 side. This piston ring 52 is formed by the compression ring 53 and the oil ring 51. The compression ring 53 needs to always be tightly attached to the cylinder part 3 because it is provided to separate the combustion chamber 8 from the crank chamber 7. In addition, the compression ring 53 needs to lubricate to prevent abrasion because it slidably moves. Therefore, there is much more oil in the gap portion between the cylinder part 3 and the piston 9 in the combustion chamber 8 side than in the region between the compression ring 53 and the oil ring 51. By the way, when the four-stroke engine 1 according to the present invention is applied to a working machine such as a brush cutter and a chain saw whose body posture is changed significantly, the communicating passage 104 may be located in the lower side of the engine body in working condition. In addition, a case is possible where the user leaves the working machine while the communicating passage 104 is located in the lower side. This causes a problem that the diaphragm 108 of the carburetor 25 does not normally operate because oil enters the carburetor 25 via the communication passage 104. The present invention aims to prevent this problem by means of the elastic film 127, as an exemplary flowback prevention part.

If the crank chamber side opening 103 is formed in the position apart from the position in which the oil ring 51 in the piston 9 is located when the piston 9 is located at BDC, it is required to increase the length of the skirt part 9*b* accordingly, and consequently increase the size of the piston 9. Therefore, with the present embodiment, the crank chamber side opening 103 is formed the vicinity of the oil ring 51 in the piston 9 when the piston 9 is located at BDC to reduce the size of the piston 9 and prevent oil from collecting in the crank chamber side opening 103.

Here, with the present invention, a configuration is adopted where oil is not allowed to enter the communicating passage 104, the crank chamber side opening 103 does not need to be located in the vicinity of the termination portion 9*c* of the skirt part 9*b* of the piston 9 when the piston 9 arrives at TDC. However, by providing the crank chamber side opening 103 at the position shown in FIG. 12, it is possible to apply a pulsed negative pressure to the diaphragm chamber 110 via the communicating passage 104. The reason why the crank chamber side opening 103 is provided at this position is that the crank chamber side opening 103 is covered with the skirt part 9*b* of the piston 9 until the piston 9 arrives at the vicinity of TDC even if a negative pressure is created in the crank chamber 7. Then, when the piston 9 arrives at the vicinity of TDC, the negative pressure in the crank chamber 7 is maximized (minimized). In this state, the skirt part 9*b* having covered the crank chamber opening 103 moves, and is removed. As a result, a pulsed negative pressure is applied to the diaphragm chamber 110 via the communicating passage 104. For this reason, with Embodiment 5, it is possible to drive the diaphragm fuel pump 109 powerfully. However, the position of the crank chamber side opening 103 is not limited to this, but the diaphragm fuel pump 109 can be driven as long as the crank chamber side opening 103 is located in a place in which a negative pressure is created.

Here, the communicating passage 104 is filled with fluid. Although, normally the communicating passage 104 is filled with air, it is by no means limiting. The communicating passage 104 may be filled with nitrogen gas and so forth. Alternatively, the communicating passage 104 may be filled with liquid such as oil.

Figure 13:
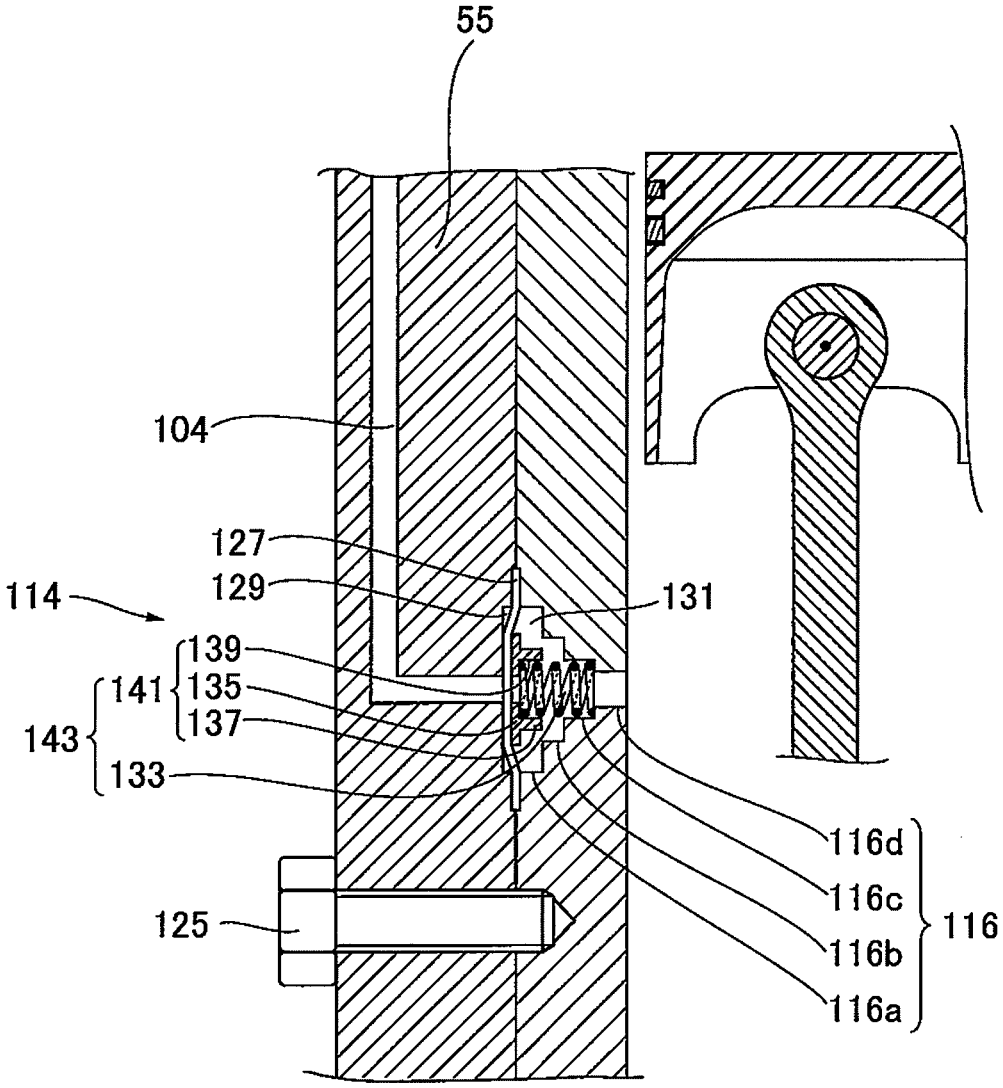
FIG. 13 is a drawing showing the configuration of a pressure applying part.

FIG. 13 is a drawing showing the configuration of the pressure applying part 114.

As shown in FIG. 13, it is preferable to form the communicating passage 104 in the side member 55. This side member 55 allows the communicating passage 104 to be formed, and also allows the elastic film 127 in the pressure applying part 114 to be positioned and fixed onto a predetermined position. Moreover, various passages that allow, for example, oil, fuel, air and blowby gas to flow through may be formed in the side member 55. Moreover, the side member 55 may function to hold the carburetor 25, the air cleaner 21 and so forth. In addition, the side member 55 may be formed integrally with the carburetor 25, the air cleaner 21 and so forth.

As shown in FIG. 13, the first chamber 131 is formed in the cylinder part 3. This first chamber 131 is constituted by a plurality of cavity portions 116. To be more specific, the cylinder part 3 includes the first cylindrical space 116*a*, the second cylindrical space 116*b* and the third cylindrical space 116*c* to arrange them from the outer periphery to the center in this order as shown in FIG. 13. The diameter of the first cylindrical space 116*a* is greater than that of the second cylindrical space 116*b*. The diameter of the second cylindrical space 116*b* is greater than that of the third cylindrical space 116*c*. The diameter of the third cylindrical space 116*c* is greater than that of the fourth cylindrical space 116*d*. The first cylindrical space 116*a*, the second cylindrical space 116*b*, the third cylindrical space 116*c*, and the fourth cylindrical space 116*d* are formed concentrically.

The second chamber 129 is formed in the side member 55. Here, the cross section of the cylindrical second chamber 129 is the same as that of the first cylindrical space 116*a*.

The elastic film 127 is disposed between the first chamber 31 and the second chamber 129. This elastic film 127 is sandwiched and held between the side surface of the side member 55 in the cylinder part 3 side and the outer surface of the cylinder part 3. Here, although with FIG. 13, there is no cylindrical hollow and so forth to hold the elastic film 127, a cylindrical hollow may be provided to hold the elastic film 127 such that the outer rim of the elastic film 127 is fit into the cylindrical hollow.

The elastic film 127 includes a bias member 143 to bias the elastic film 127 to the side member 55 side (second chamber 129 side). This bias member 143 includes an elastic member 133 (helical spring) and an elastic member holding part 141. The elastic member holding part 141 includes a first holding part 135 and a second holding part 137. The first holding part 135 is formed as a low column. The second holding part 137 is formed as a cylinder having a cylindrical hollow space 139 therein. The first holding part 135 is connected to the elastic film 127 with adhesive. The elastic member 133 having the same outer periphery as the inner periphery of the inner space 139 is inserted in the inner space 139. By this means, the elastic member 133 is held. One end of the elastic member 133, which is opposite to the end inserted in the inner space 139, is inserted in the third cylindrical space 116*c*. Then, the end of the elastic member 133, which is opposite to the end inserted in the inner space 139, contacts the end of the third cylindrical space 116*c* in the fourth cylindrical space 116 side. In this state, the elastic member 133 is shrunk.

The pressure applying part 114 is disposed in the cylinder part 3, and therefore needs to have heat resistance. Moreover, the pressure applying part 114 also needs to have oil resistance because there is oil in the cylinder part 3. Particularly, the elastic film 127 needs to be made of rubber and so forth having elasticity. If not so, the elastic film 127 would not have satisfactory oil resistance, in particular, heat resistance. Therefore, the elastic film 127 must be made of a material having oil resistance, in particular, heat resistance.

The side member 55 is attached to the cylinder part 3 with a bolt member 125. By this means, it is possible to readily position and fix the side member 55 onto a predetermined position of the cylinder part 3. As a result, it is possible to readily position and fix the pressure applying part 114 (particularly elastic film 127). As a result, the four-stroke engine 1 can be more simply assembled. In addition, it is possible to reduce the number of parts. Here, the bolt member 125 is not limited to a bolt as long as the side member 55 can be positioned and fixed onto a predetermined position of the cylinder part 3.

As shown in FIG. 13, the elastic film 127 is biased to the second chamber 129, so that it is possible to apply only negative pressure to the diaphragm chamber 110.

Figure 14:
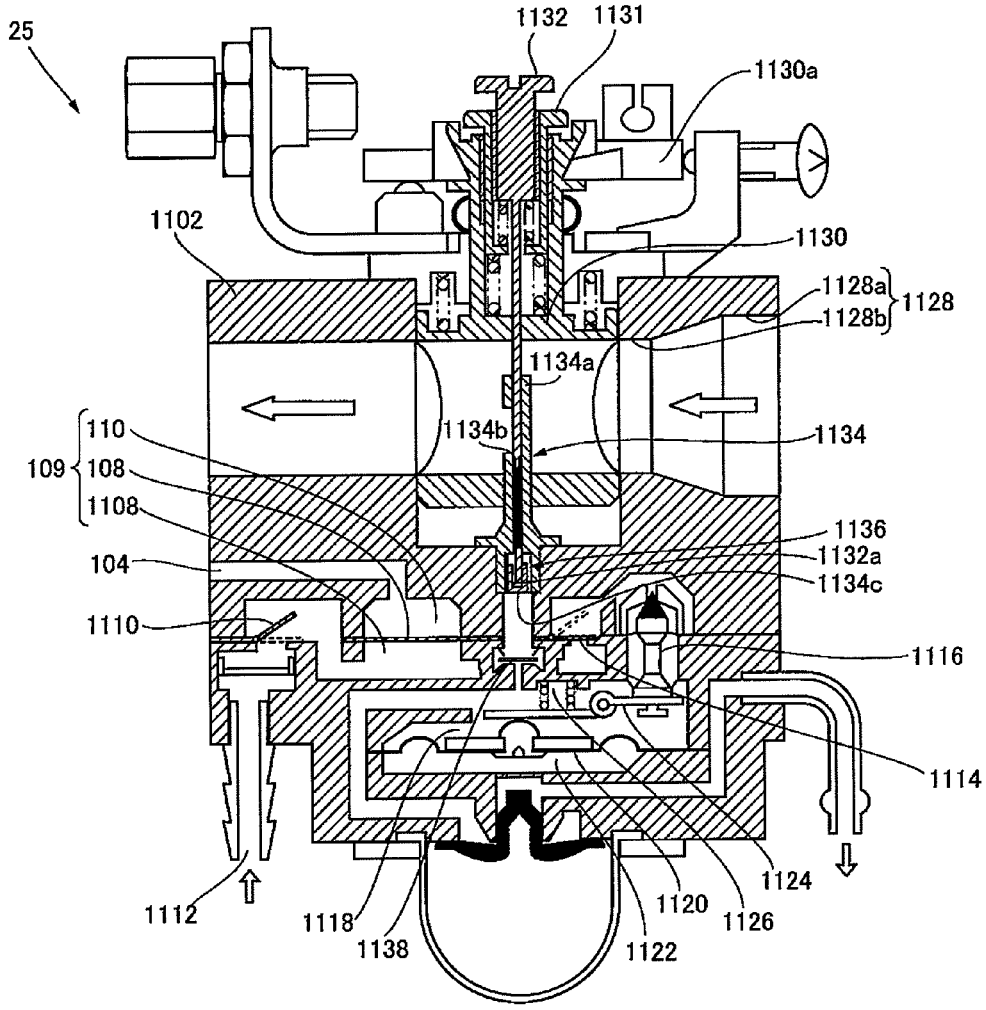
FIG. 14 is a drawing showing the configuration of the carburetor to which a diaphragm fuel pump is applied.

FIG. 14 is a drawing showing the configuration of the carburetor 25 to which a diaphragm fuel pump 109 is applied.

As shown in FIG. 14, the carburetor 25 includes the carburetor body 1102. The communicating passage 104 which allows communication with the crank chamber 7, is formed in the carburetor body 1102. This communicating passage 104 faces the diaphragm chamber 110, which is one side (the upper part in the figure) of the diaphragm fuel pump 109. The pump chamber 1108 is formed in the other side (the lower part in the figure) of the diaphragm fuel pump 109. The fuel inlet 1112 communicates with the pump chamber 1108 via the inlet valve 1110, and the metering chamber 118 in the metering diaphragm 1120 communicates with the pump chamber 1108 via the outlet valve 1114 and the needle valve 1116. Here, the fuel inlet 1112 is connected to the fuel tank (not shown). The crank chamber side opening 103 of the communicating passage 104 in the crank chamber 7 side is formed in the cylinder part 3 which defines the crank chamber 7.

The pressure in the crank chamber 7 varies according to a change in its volume. As described above, only a negative pressure of the varying pressure affects the diaphragm chamber 110 via the communicating passage 104. Then, the diaphragm fuel pump 109 is driven by the negative pressure affecting the diaphragm chamber 110. To be more specific, a negative pressure affects the diaphragm chamber 110 in the diaphragm fuel pump 109, and therefore the negative pressure affects the pump chamber 1108 side when the diaphragm 108 bends to the diaphragm chamber 110 side. The negative pressure in the pump chamber 1108 allows the inlet valve 1110 to open while the outlet valve 1114 is closed, and therefore fuel is sucked from the fuel inlet 1112 into the pump chamber 1108. Next, in this state, when the negative pressure affecting the diaphragm chamber 110 in the diaphragm fuel pump 109 changes to a positive pressure, the elastic force of the diaphragm 108 forces the diaphragm 108 to return to the original state. Therefore, a positive pressure affects the pump chamber 1108 side. Then, when the motion of the diaphragm 108 causes the positive pressure to affect the pump chamber 1108 side, the outlet valve 1114 opens while the inlet valve 1110 remains closed to discharge the fuel from the pump chamber 1108. This discharged fuel is supplied to the metering chamber 1118 in the metering diaphragm 1120 via the needle valve 1116.

The metering chamber 1118 is separated from a back pressure chamber 1122 by the metering diaphragm 1120. The pressure of the four-stroke engine 1 affects the back pressure chamber 1122. The metering diaphragm 1120 is driven by the difference in pressure between the four-stroke engine 1 and the metering chamber 1118. Here, a passage is not shown in the figure, which allows communication between the back pressure chamber 1122 and the space under a negative pressure in the engine. The metering diaphragm 1120 is connected to the above-described needle valve 1116 via the control lever 1124, and operates to open and close the needle valve 1116. To be more specific, when the metering chamber 1118 is filled with fuel, the pressure in the metering chamber 1118 rises and the metering diaphragm 1120 bends to the back pressure chamber 1122 side. At this time, the elastic force of the control lever spring 1126 causes the control lever 1124 to rotate such that one end (the left side in the figure) of the control lever 1124 is pushed down and the other end (the right side in the figure) is pushed up. This rotation of the control lever 1124 causes the needle valve 1116 to push up and breaks the communication between the pump chamber 1108 and the metering chamber 1118.

The passage 1128 is formed in the carburetor body 1102 to connect between the intake port 27 formed in the cylinder part 3 and the air cleaner 21. This passage 1128 has the large diameter part 1128*a* in the upper stream side (the air cleaner 21 side) and the smaller venturi part 1128*b* in the downstream side (the intake port 27 side) than the large diameter part 1128*a*. The venturi part 1128*b* includes the throttle valve 1130 to change its opening. The axis of rotation of the throttle valve 1130 is orthogonal to the passage 1128. By operating a rotating lever 1130*a*, the throttle valve 1130 rotates, sliding upward and downward in the figure to change the opening of the venturi part 1128*b* according to the degree of rotation.

In addition, this throttle valve 1130 is provided with the first adjuster screw 1131 which is coaxial with the axis of rotation of the throttle valve 1130 to fine-tune the amount of fuel mixed into the air flowing through the passage 1128. This first adjuster screw 1131 is provided with the second adjuster screw 1132 which is coaxial with the axis of rotation of the first adjuster screw 1131. The second adjuster screw 1132 is provided to extend upward and downward in the figure. The outer diameter of the second adjuster screw 1132, which is approximately the same as the inner diameter of the nozzle 1134 described later, reduces from the top to the bottom in two steps. The switching part 1132*a* to switch a main jet 1136 described later is provided on the tip of the second adjuster screw 1132. In the figure, the first adjuster screw 1131 moves downward, rotating in one direction (to tighten the screw) with respect to the throttle valve 1130, and, on the other hand, moves upward, rotating in the other direction (to loosen the screw) with respect to the throttle valve 1130. Likewise, in the figure, the second adjuster screw 1132 moves downward, rotating in one direction (to tighten the screw) with respect to the first adjuster screw 1131, and, on the other hand, moves upward, rotating in the other direction (to loosen the screw) with respect to the first adjuster screw 1131.

The nozzle 1134 is provided in the carburetor body 1102 to face the second adjuster screw 1132. The tip of the second adjuster screw 1132 is inserted into the nozzle tip 1134*a* of the nozzle 1134. In addition, the nozzle 1134 includes a hole 1134*b* which is open in the passage 1128. A bottom 1134*c* in communication with the hole 1134*b* faces the metering chamber 1118. Here, the main jet 1136 and a main check valve 1138, which serve as a mixture ratio adjusting means and fuel adjusting mechanism, are provided between the hole 1134*b* and the metering chamber 1118.

Figure 15:
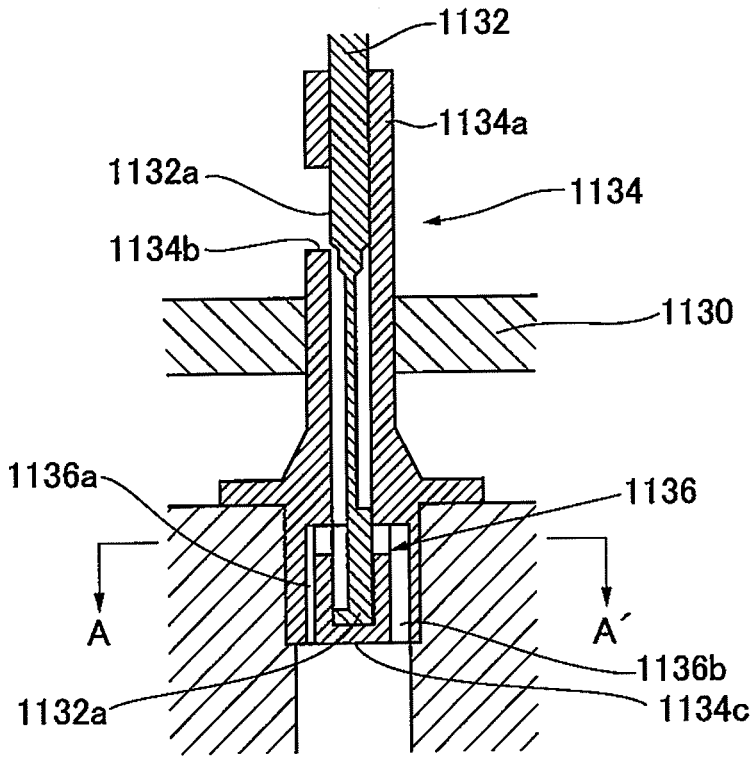
FIG. 15 is a drawing showing the nozzle.
Figure 16:
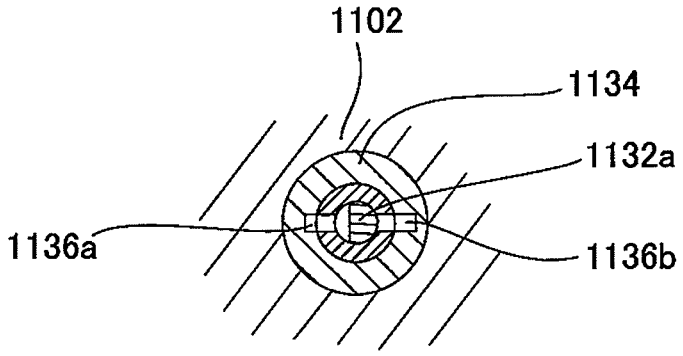
FIG. 16 is a cross sectional view of FIG. 15 taken along line A-A.

FIG. 15 is a drawing showing the nozzle 1134. FIG. 16 is a cross sectional view of FIG. 15 taken along line A-A.

As shown in FIG. 15 and FIG. 16, the main jet 1136 includes the first main jet part 1136*a* and the second main jet part 1136*b*. The first main jet part 1136*a* has a predetermined opening area to allow communication between the hole 1134*b* of the nozzle 1134 and the metering chamber 1118. The second main jet part 1136*b* has a lager opening area than of the first main jet part 1136*a* to allow communication between the hole 1134*b* of the nozzle 1134 and the metering chamber 1118. One of the first main jet part 1136*a* and the second main jet part 1136*b* of the main jet 1136 is closed by the switching part 1132*a* in the second adjuster screw 1132, and the other allows communication between the hole 1134*b* of the nozzle 1134 and the metering chamber 1118. By rotating the second adjuster screw 1132 with respect to the first adjuster screw 1131, it is possible to switch between open and close of the first main jet part 1136*a* and the second main jet part 1136*b* of the main jet 1136. That is, by rotating the second adjuster screw 1132 with respect to the first adjuster screw 1131 according to fuel to be used, it is possible to deliver fuel to one of the first main jet part 1136*a* and the second main jet part 1136*b* of the main jet 1136.

Embodiment 6

Figure 17:
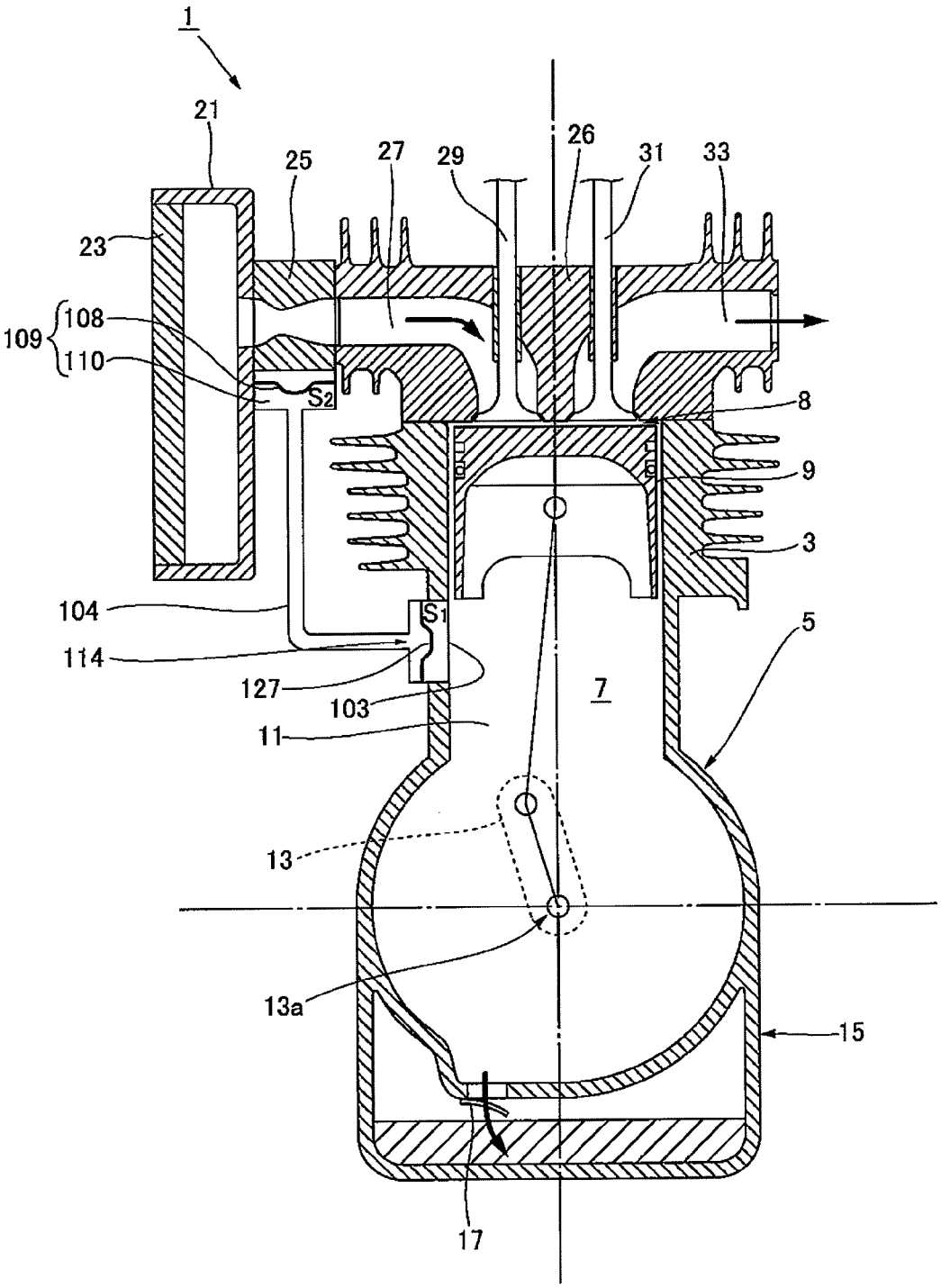
FIG. 17 is a schematic view showing the four-stroke engine according to Embodiment 6 of the present invention.

FIG. 17 is a schematic view showing the four-stroke engine according to Embodiment 6 of the present invention.

As shown in FIG. 17, the cross section of the pressure applying part 114 including the elastic film 127 is referred to as a first cross section S1, and the cross section of the diaphragm chamber 110 in the diaphragm fuel pump 109 is referred to as a second cross section S2. In other words, the cross-section of the diaphragm chamber 110 in the diaphragm fuel pump 109 is orthogonal to the normal of the diaphragm 108. In other words, the cross section of the pressure applying part 114 is orthogonal to the normal of the elastic film 127.

In this way, it is possible to set the first cross section S1 of the pressure applying part 114 and the second cross section S2 of the diaphragm chamber 110 individually. This allows a pressure (amplitude) required to drive the diaphragm fuel pump 109 to be appropriately applied. To be more specific, when a large amplitude is required to drive the diaphragm fuel pump 109, it is possible to increase the first cross section S1. On the other hand, when a small amplitude is enough to drive the diaphragm fuel pump 109, it is possible to reduce the first cross section S1. With the present invention, particularly, a configuration is possible to prevent oil from entering the communicating passage 104 and also to use both a negative pressure and a positive pressure, and therefore to prevent the parts that communicate with the elastic film 127, from being limited to a specific part (for example, the crank chamber 7). As a result, it is possible to dispose a pressure fluctuation part in which there is pressure fluctuation at any positions. In addition, even if a part with little pressure fluctuation communicates with the elastic film 127, it is possible to drive the diaphragm fuel pump 109 by increasing the first cross section S1. That is, it is possible to achieve a degree of freedom, that is, it is possible to freely position the part that communicates with the elastic film 127, by making a difference between the first cross section S1 and the second cross section S2 (see also FIG. 18).

Embodiment 7

Figure 18:
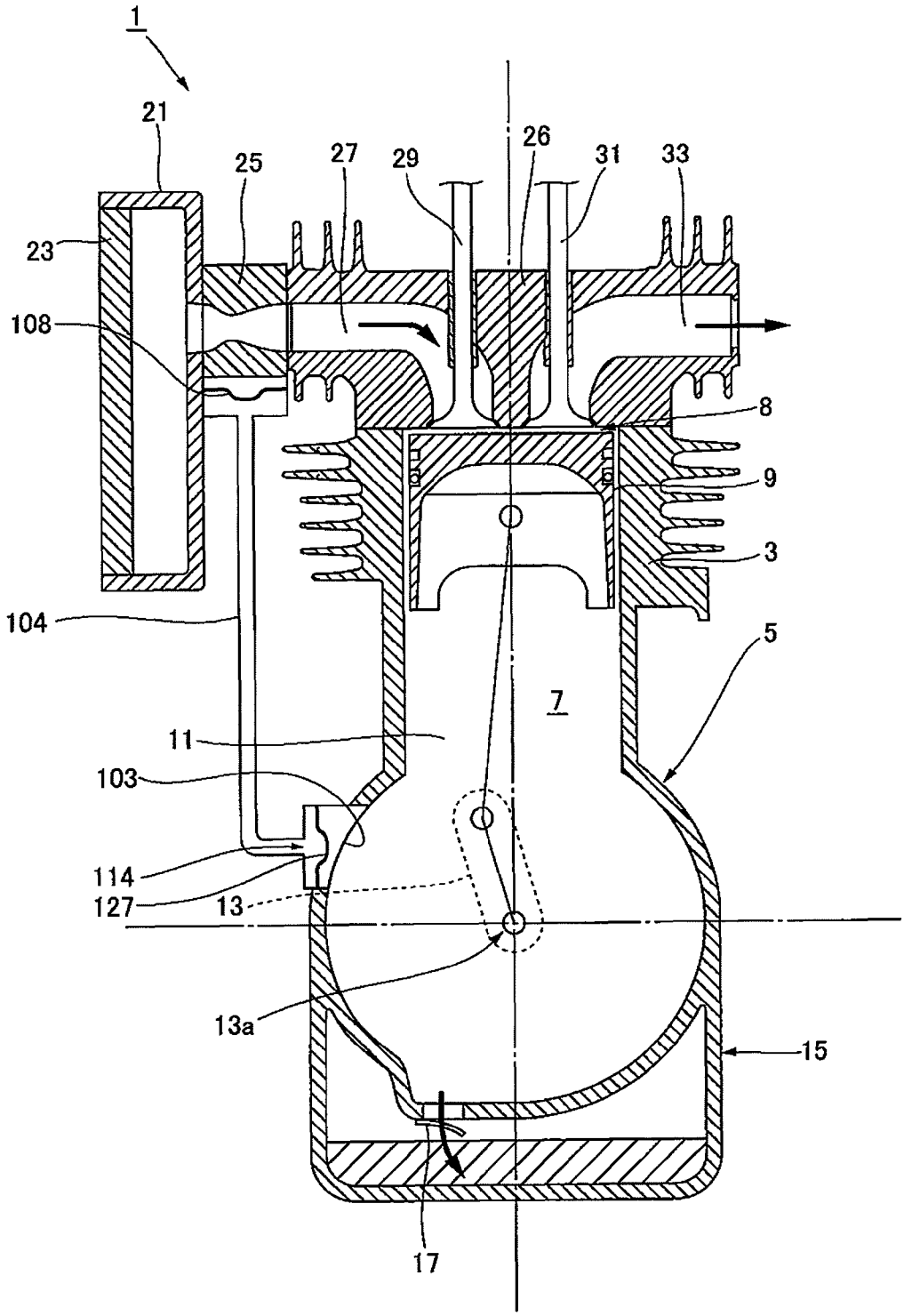
FIG. 18 is a schematic view showing the four-stroke engine according to Embodiment 7 of the present invention.

FIG. 18 is a schematic view showing the four-stroke engine according to Embodiment 7 of the present invention.

As shown in FIG. 18, the crankcase 5 may communicate with the elastic film 127 instead of the cylinder part 3. It is because, with the present invention, both negative pressure and positive pressure can be used, the parts that communicate with the elastic film 127 are not limited to a specific part (for example, the cylinder part 3). In addition, with the present invention, oil does not enter the communicating passage 104, and therefore it is possible to provide apart that communicates with the elastic film 127 in the crankcase 5 in which a positive pressure may be created.

Embodiment 8

Figure 19:
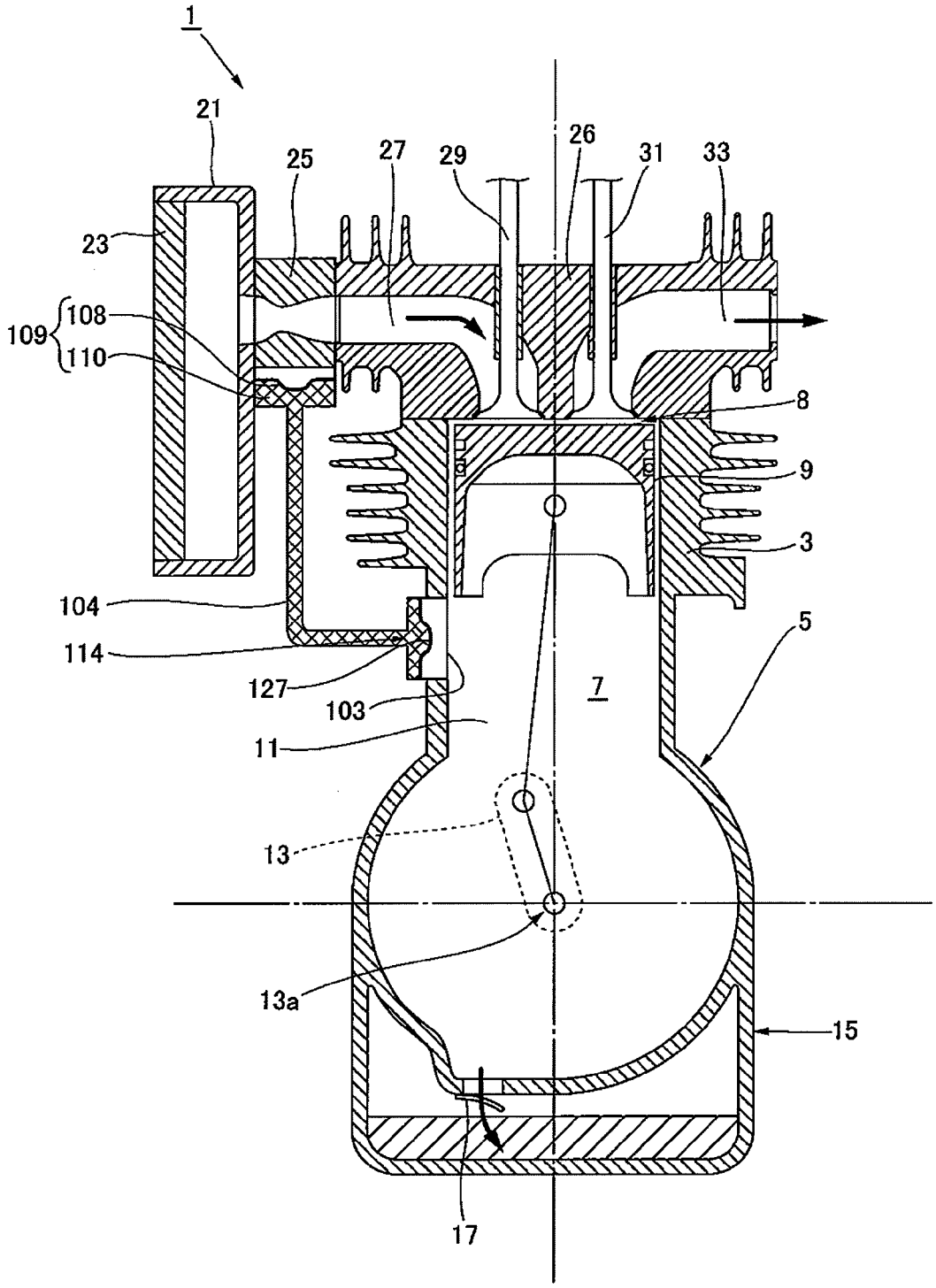
FIG. 19 is a schematic view showing the four-stroke engine according to Embodiment 8 of the present invention.

FIG. 19 is a schematic view showing the four-stroke engine according to Embodiment 8 of the present invention.

As shown in FIG. 19, the communicating passage 104 allows liquid such as oil, water and so forth to flow through. In this case, it is possible to more reliably apply the pressure from the pressure applying part 114 to the diaphragm chamber 110. FIG. 19 shows a configuration in which a negative pressure is used, and this configuration is advantageous to the diaphragm fuel pump 109 using a positive pressure. Here, negative pressure is effectively used within a range of atmosphere pressure.

Embodiment 9

Figure 20:
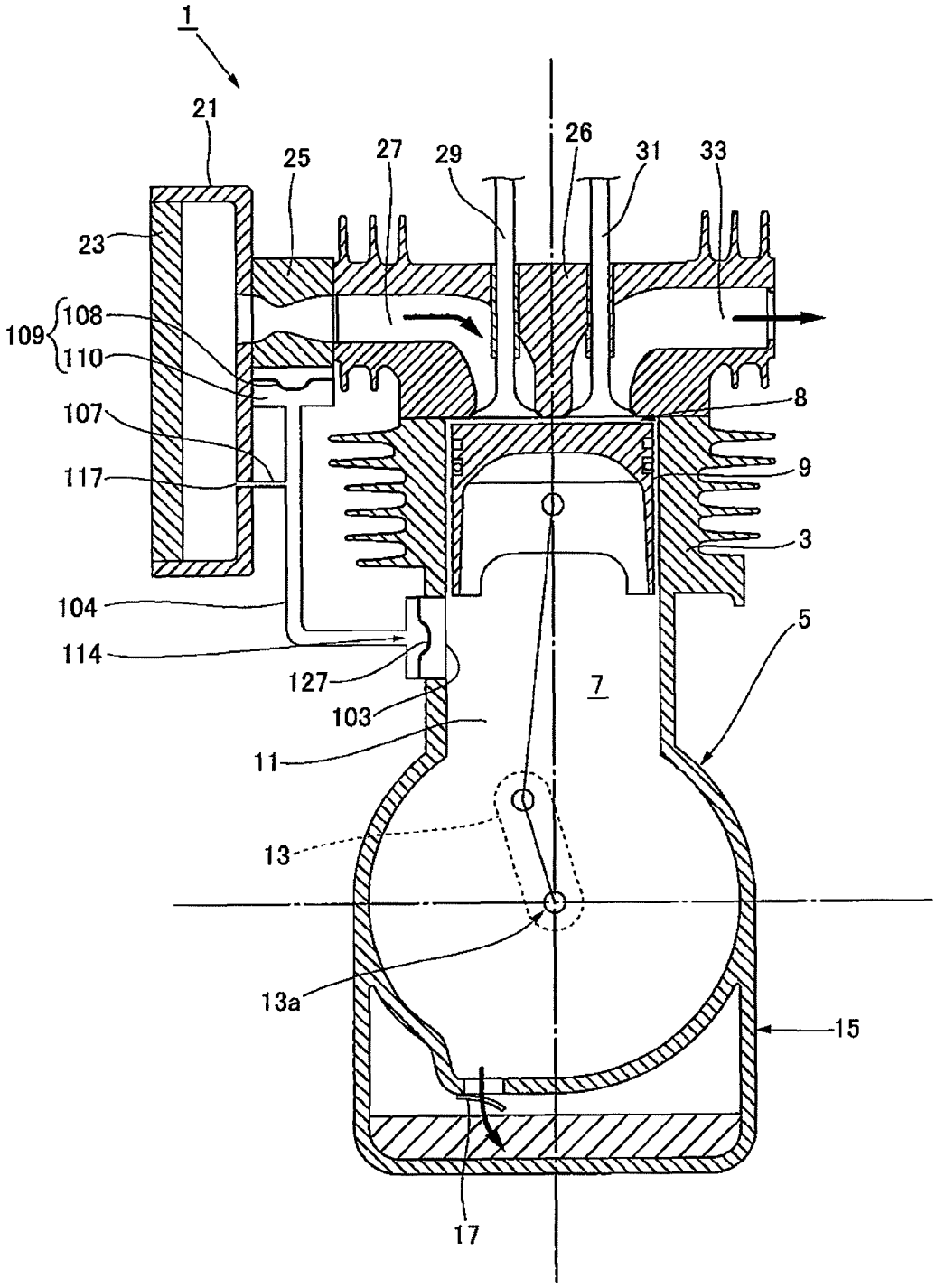
FIG. 20 is a schematic view showing the four-stroke engine according to Embodiment 9 of the present invention.

FIG. 20 is a schematic view showing the four-stroke engine according to Embodiment 9 of the present invention.

With the above-described embodiments, the communicating passage 104 has a sealed structure. Here, the four-stroke engine 1 generates a large amount of heat while driving. Here, the communicating passage 104 is highly likely to be located in the vicinity of the combustion chamber 8. Particularly, as shown in FIG. 13, when the side member 55 in which the communicating passage 104 is formed contacts the cylinder part 3, the communicating passage 104 tends to be heated. In addition, when the four-stroke engine 1 is used in a hot whether area, the temperature of the inside of the communicating passage 104 increases independent of the heat of the combustion chamber 8. If the temperature of the communicating passage 104 increases, the elastic film 127 shown in FIG. 13 always contacts the first chamber 131. As a result, the pressure applying part 114 cannot transmit pressure fluctuation to the diaphragm fuel pump 109. In addition, the same case is likely to occur in an area at a high altitude and a low pressure. To address this problem, the atmospheric pressure opening passage 107 as shown in FIG. 20 is provided. This atmospheric pressure opening passage 107 has the air cleaner side opening 117 in the air cleaner 21. This atmospheric pressure opening passage 107 communicates with the atmospheric pressure side with an aperture area that rarely allows gas to enter and exit the communicating passage 104 when the diaphragm 108 moves. In this way, by providing the air cleaner side opening 117, the degree of the pressure fluctuation applied to the diaphragm chamber 110 is reduced. Therefore, it is possible to reduce the influence of heat and atmospheric pressure while preventing the performance of the diaphragm fuel pump 109 from deteriorating. Here, it is no problem that the speed at which the air flows in and out of the atmospheric pressure opening passage 107 is slow, and therefore the communicating passage 104 may communicate with the atmospheric pressure side with an aperture area that rarely allows gas to enter and exit the communicating passage 104.

Here, with the present embodiment, the atmospheric pressure opening passage 107 is open in the air cleaner 21. However, the atmospheric pressure opening passage 107 is not necessarily be open in the air cleaner 21 because it is sufficient for the atmospheric pressure opening passage 107 to communicate with the atmospheric pressure side. Here, if the atmospheric pressure opening passage 107 is open in the air cleaner 21, conveniently, it is possible to prevent dust, water and so forth from entering the communication passage 104.

Embodiment 10

Figure 21:
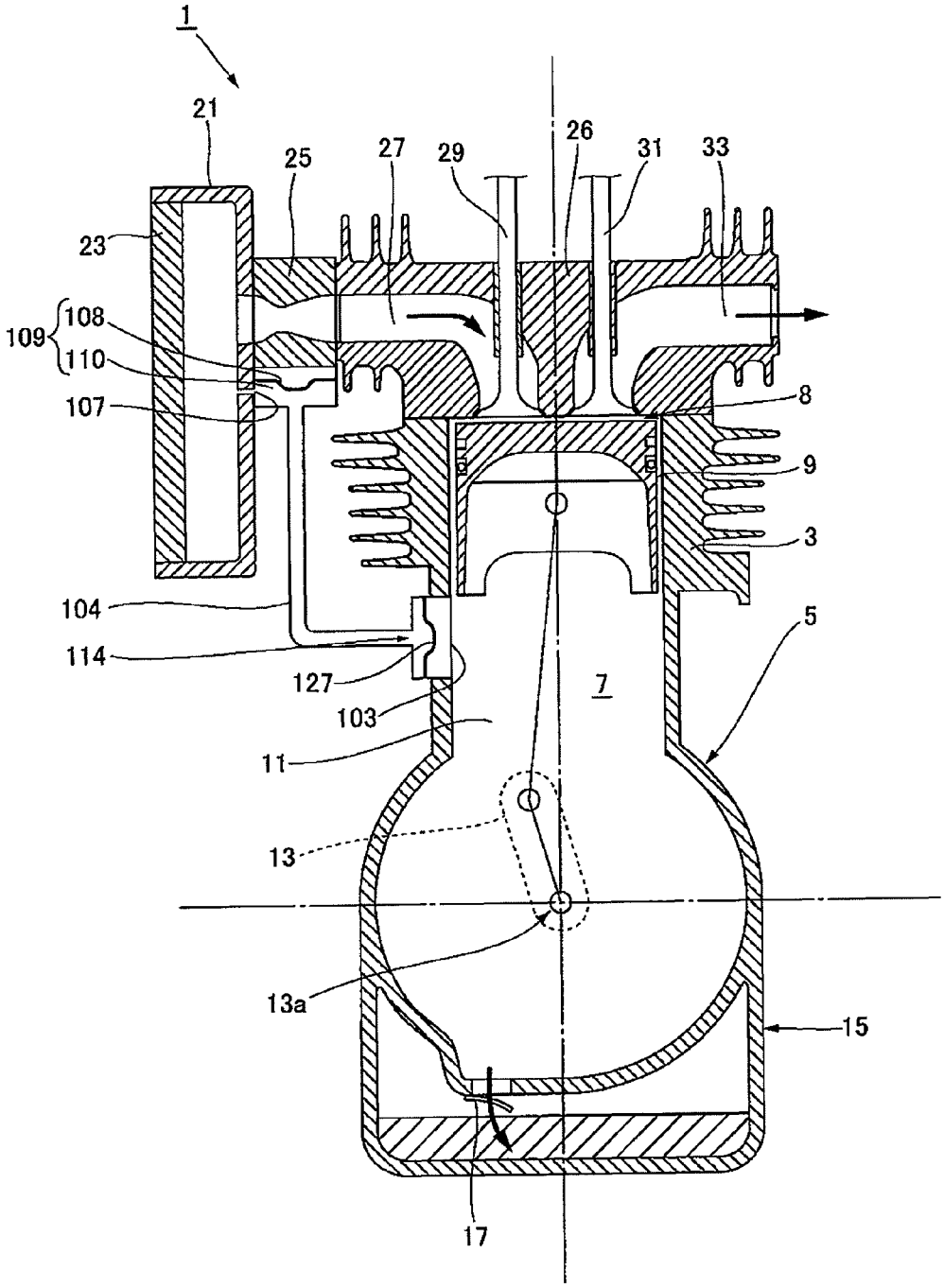
FIG. 21 is a schematic view showing the four-stroke engine according to Embodiment 10 of the present invention.

FIG. 21 is a schematic view showing the four-stroke engine according to Embodiment 10 of the present invention.

As shown in FIG. 21, the atmospheric opening passage 107 is formed in the carburetor 25, and therefore it is possible to provide an advantage of easy fabrication.

The Configurations and Effects of the Embodiments

The four-stroke engine 1 according to the present invention includes the piston 9 and the carburetor 25; the carburetor 25 includes the diaphragm fuel pump 109; the diaphragm fuel pump 109 includes the pump chamber 1108 that sucks and discharges fuel, a diaphragm chamber 110 to which the pressure to drive the pump chamber 1108 is applied, and the communicating passage 104 that connects between the negative pressure part in which a negative pressure is created due to the movement of the piston 9 and the diaphragm chamber 110. The flowback prevention part (check valve 115) is provided in the communicating passage 104 to allow fluid to move only in one direction from the diaphragm chamber 110 side to the negative pressure part (in the cylinder part 3). With this configuration, it is possible to provide an engine configured to reliably prevent oil from entering the communicating passage 104 to which a negative pressure is applied while the negative pressure is applied from the negative part to the diaphragm chamber 110 of the diaphragm fuel pump 109.

The negative pressure part (in the cylinder part 3) may be the crank chamber 7 through which the piston 9 slidably moves. With this configuration, it is possible to reliably apply a negative pressure to the diaphragm chamber 110, and therefore to improve the performance of the diaphragm fuel pump 109.

The flowback prevention part (check valve 115) is formed in the crank chamber side opening 103 of the cylinder part 3. With this configuration, it is possible to apply a pulsed negative pressure to the diaphragm chamber 110, and therefore to improve the performance of the diaphragm fuel pump 109.

The communicating passage 104 is formed in the side member 55 contacting the cylinder part 3. The side member 55 positions and fixes the flowback prevention part (check valve 115) in the cylinder part 3. With this configuration, the four-stroke engine 1 can be more simply assembled.

The atmospheric pressure opening passage 107 that communicates with the space under atmospheric pressure is connected to the communicating passage 104. With this configuration, it is possible to continuously drive the diaphragm fuel pump 109.

The atmospheric pressure opening passage 107 that communicates with the atmospheric pressure side is connected to the diaphragm chamber 110. With this configuration, it is possible to easily form the atmospheric pressure opening passage 107 by providing a passage that penetrates the carburetor 25.

The atmospheric pressure opening passage 107 is formed in the carburetor 25 and is open in the air filter 21. With this configuration, it is possible to prevent dust and so forth from entering the diaphragm fuel pump 109. Moreover, it is possible to prevent dust and so forth from entering the cylinder part 3.

The opening (crank chamber side opening 103) of the communicating passage 104 in the crank chamber 7 side is formed to open in the position in the vicinity of the termination portion 9*c* of the skirt part 9*b* of the piston 9 when the piston 9 is located at TDC. With this configuration, it is possible to apply a pulsed negative pressure to the diaphragm chamber 110, and therefore to improve the performance of the diaphragm fuel pump 109.

Moreover, the opening (crank chamber side opening 103) of the communicating passage 104 in the crank chamber 7 side is formed to open in the position closer to the crank axle 13*a* than the piston ring 52 when the piston 9 is located at TDC. With this configuration, it is possible to prevent oil from adhering to the crank chamber opening 103.

The opening (crank chamber side opening 103) of the communicating passage 104 in the crank chamber 7 side is formed in the vicinity of the piston ring 52 of the piston 9 when the piston 9 is located at BDC. With this configuration, it is possible to reduce the size of the piston 9 and prevent oil from collecting in the crank chamber side opening 103.

The orifice (air cleaner side orifice 111) is formed in the atmospheric pressure opening passage 107 that is connected to the communicating passage 104 or the diaphragm chamber 110 to communicate with the space under atmospheric pressure. With this configuration, it is possible to easily realize the pipeline resistance of the communicating passage 104 as planned.

The four-stroke engine 1 according to the present invention includes the piston 9, the carburetor 25, the elastic film 127, the first chamber 131 formed on one side of the elastic film 127 and the second chamber 129 formed on the other side of the elastic film 127. The carburetor 25 includes the diaphragm fuel pump 109. The diaphragm fuel pump 109 includes the diaphragm chamber 110 to which a pressure to drive the pump chamber 1108 is applied, and the pump chamber 1108 that sucks and discharges fuel. The first chamber 131 communicates with the pressure fluctuation part (e.g. cylinder part 3) in which there is pressure fluctuation due to the movement of the piston 9. The second chamber 129 communicates with the diaphragm chamber 110. With this configuration, it is possible to provide an engine configured to prevent oil from flowing into the communicating passage that provides pressure fluctuation to the diaphragm chamber, while providing driving force due to the pressure fluctuation in the pressure fluctuation part, to the diaphragm chamber of the diaphragm fuel pump.

The pressure fluctuation part communicates with the negative pressure part (e.g. cylinder part 3) in which a negative pressure is created due to the movement of the piston 9, and has the bias member (e.g. helical spring) that biases the elastic film 127 to the second chamber 129 side. With this configuration, it is possible to drive the diaphragm fuel pump 109 by effectively using negative pressure.

The second chamber 129 is formed to communicate with the cylinder part 3 in the vicinity of the termination portion 9*c* of the skirt part 9*b* of the piston 9 when the piston 9 is located at TDC. With this configuration, it is possible to apply a pulsed negative pressure to the diaphragm chamber 110, and therefore to improve the performance of the diaphragm fuel chamber 109.

The second chamber 129 is formed to communicate with the cylinder part 3 in the position closer to the crank axle 13*a* than the piston ring 52 when the piston 9 is located at BDC. With this configuration, it is possible to prevent oil from adhering to the crank chamber side opening 103.

The second chamber 129 is formed in the vicinity of the piston ring 52 of the piston 9 when the piston 9 is located at BDC. With this configuration, it is possible to reduce the size of the piston 9 and prevent oil from collecting in the crank chamber side opening 103.

The four-stroke engine 1 according to the present invention includes the side member 55 disposed on the side surface of the cylinder part 3. The communicating passage 104 that allows communication between the second chamber 129 and the diaphragm chamber 110 is formed in the side member 55. The elastic film 127 is sandwiched between the side member 55 and the cylinder part 3, and therefore is positioned and fixed onto a predetermined position. With this configuration, it is possible to readily assemble the four-stroke engine 1 having the elastic film 127. In addition, it is possible to reduce the number of parts.

The first cross section S1 is defined in the first chamber 131 and the second chamber 129 in the direction in which the elastic film 127 is formed. The second cross section S2, which is different from the first cross section S1, is defined in the pump chamber 1108 and the diaphragm chamber 110 in the direction in which the diaphragm 108 is formed. With this configuration, it is possible to achieve the degree of freedom of the design, that is, it is possible to freely position the part that communicates with the elastic film 127.

The second cross section S2 is greater than the first cross section S1. With this configuration, it is possible to provide the pressure applying part 114 that communicates with the part with little pressure fluctuation.

The four-stroke engine 1 according to the present invention includes the communicating passage 104 that allows communication between the second chamber 129 and the diaphragm chamber 110. This communicating passage 104 communicates with the atmospheric pressure side with an aperture area that rarely allows gas to enter and exit the communicating passage 104 when the diaphragm 108 moves. With this configuration, it is possible to reliably drive the diaphragm fuel pump 109 under an environment at a high temperature and a low pressure.

The communicating passage 104 is filled with liquid. With this configuration, it is possible to reliably apply the pressure in the pressure applying part 114 to the diaphragm chamber 110.

Although the description has been explained where the present invention is applied to a four-stroke engine, it is by no means limiting, but the present invention is applicable to a two-stroke engine and can provide the same effect.

In addition, the present invention is not limited to the above-described embodiments but various modifications and alterations are possible.

The negative pressure part according to the present invention is not limited as long as the pressure in the negative pressure part becomes lower than atmospheric pressure regularly. For example, the negative pressure part may be the cylinder part 3 or the crankcase 5 in the crank chamber 7, or the intake port 27. The check valve 115 is an exemplary flowback prevention part according to the present invention. The flowback prevention part according to the present invention is not limited as long as it allows fluid to move only in one direction.

With the above-described embodiments, a configuration has been explained where the cylinder head 26 is formed separately from the cylinder part 3. However another configuration is possible where the cylinder head 26 is formed integrally with the cylinder part 3, and this integrated part and the piston 9 constitute the combustion chamber. With this configuration, it is possible to provide the same effect as described above.

The pressure fluctuation part is not limited as long as the pressure in the pressure fluctuation part fluctuates regularly. The negative pressure part is an exemplary pressure fluctuation part according to the present invention. The pressure fluctuation part according to the present invention may be a part in which the pressure changes to a positive pressure. The pressure fluctuation part may be the exhaust port 33. The negative pressure part according to the present invention is not limited as long as the pressure in the negative pressure part changes from a certain pressure to a negative pressure regularly. For example, the negative pressure part may be the cylinder part 3 or the crankcase 5 in the crank chamber 7, or the intake port 27.

Here, with the above-described embodiments, a configuration has been explained where each of the plurality of hollow parts is formed as a cylinder. However, it is by no means limiting, but various shapes are possible. By this means, it is possible to provide the above-described effects. Moreover, although a configuration has been explained where the cylinder head 26 is formed separately from the cylinder part 3, another configuration is possible where the cylinder head 26 and cylinder part 3 are integrally formed, and the integrated part and the piston 9 constitute the combustion chamber. With this configuration, it is possible to produce the same effect.

The invention claimed is:

1. An engine, comprising:

a piston;

a carburetor;

an elastic film;

a first chamber formed in one side of the elastic film;

a second chamber formed in the other side of the elastic film; and a diaphragm fuel pump provided in the carburetor, the diaphragm fuel pump including:

a pump chamber configured to suck and discharge fuel; and a diaphragm chamber to which a pressure to drive the pump chamber is applied, wherein:

the first chamber communicates with a pressure fluctuation part in which there is pressure fluctuation due to movement of the piston;

the pressure fluctuation part being a crank chamber;

the second chamber communicates with the diaphragm chamber; and the elastic film is displaced with the pressure fluctuation in the crank chamber to communicate the pressure fluctuation to the diaphragm chamber via fluid or air in the second chamber.

2. The engine according to claim 1, wherein:

the pressure fluctuation part communicates with a negative pressure part in which a negative pressure is created due to the movement of the piston; and a bias member is provided in the pressure fluctuation part to bias the elastic film to the second chamber.

3. The engine according to claim 2, wherein the second chamber is formed to communicate with a cylinder part in a vicinity of a termination portion of a skirt part of the piston when the piston is located at a top dead center.

4. The engine according to claim 2, wherein the second chamber is formed to communicate with a cylinder part in a position closer to a crank axle than a piston ring when the piston is located at a bottom dead center.

5. The engine according to claim 4, wherein the second chamber is formed in a vicinity of the piston ring of the piston when the piston is located at the bottom dead center.

6. The engine according to claim 1, further comprising a side member disposed on a side surface of a cylinder part, wherein:

a communicating passage is formed in the side member to allow communication between the second chamber and the diaphragm chamber; and the elastic film is sandwiched between the side member and the cylinder part, and therefore is positioned and fixed onto a predetermined position.

7. The engine according to claim 1, wherein:

a first cross section is defined in the first chamber and the second chamber in a direction in which the elastic film is formed; and a second cross section is defined in the pump chamber and the diaphragm chamber in a direction in which a diaphragm is formed, the second cross section being different from the first cross section.

8. The engine according to claim 7, wherein the second cross section is greater than the first cross section.

9. The engine according to claim 1, further comprising a communicating passage configured to allow communication between the second chamber and the diaphragm chamber, wherein the communicating passage communicates with an atmospheric pressure side with an aperture area that rarely allows gas to enter and exit the communicating passage when the diaphragm moves.

10. The engine according to claim 1, wherein the communicating passage is filled with liquid.

* * * * *